US006898874B2

(12) United States Patent
Emerson et al.

(10) Patent No.: US 6,898,874 B2
(45) Date of Patent: May 31, 2005

(54) SNOWSHOE WITH TWO DEGREES OF ROTATIONAL FREEDOM

(75) Inventors: Daniel T. Emerson, Berkeley, CA (US); Rudy Lucas Samuels, Los Angeles, CA (US); Charles Bentley Warner, San Francisco, CA (US)

(73) Assignee: K2 Snowshoes, Inc., Carlsbad, CA (US)

( * ) Notice: Subject to any disclaimer, the term of this patent is extended or adjusted under 35 U.S.C. 154(b) by 128 days.

(21) Appl. No.: 10/039,166

(22) Filed: Jan. 4, 2002

(65) Prior Publication Data

US 2003/0126764 A1 Jul. 10, 2003

(51) Int. Cl.[7] ..... A43B 5/00
(52) U.S. Cl. ..... 36/122; 36/124; 36/125
(58) Field of Search ..... 36/122, 123, 124, 36/125

(56) References Cited

U.S. PATENT DOCUMENTS

| | | | | | |
|---|---|---|---|---|---|
| 2,769,250 | A | * | 11/1956 | Rinkinen | 36/124 |
| 3,802,100 | A | * | 4/1974 | Prater | 36/124 |
| 4,720,928 | A | * | 1/1988 | Faber et al. | 36/122 |
| 5,440,827 | A | | 8/1995 | Klebahn et al. | |
| 5,517,772 | A | * | 5/1996 | Anderson | 36/122 |
| 5,517,773 | A | * | 5/1996 | Forrest et al. | 36/123 |
| 5,682,688 | A | * | 11/1997 | Gallay | 36/122 |
| 5,687,491 | A | | 11/1997 | Klebahn | |
| 5,699,630 | A | | 12/1997 | Klebahn et al. | |
| 5,813,147 | A | * | 9/1998 | Burnet et al. | 36/122 |
| 5,946,829 | A | | 9/1999 | Quellais et al. | |
| 6,012,238 | A | * | 1/2000 | McKenzie et al. | 36/125 |
| 6,026,597 | A | * | 2/2000 | Burnet et al. | 36/124 |
| 6,052,922 | A | * | 4/2000 | Bleck | 36/124 |
| 6,256,908 | B1 | | 7/2001 | Warner | |

* cited by examiner

*Primary Examiner*—M. D. Patterson
(74) *Attorney, Agent, or Firm*—Thomas M Freiburger

(57) ABSTRACT

A snowshoe has a pivoted mounting on its boot harness, for rotation about a pitch axis for a first degree of freedom in movement of the user's boot relative to the snowshoe; and provision for a second degree of freedom of motion along a roll axis, allowing the user's boot to tip from side to side, particularly for uneven or sidehill terrain. In both axes the boot preferably is spring-biased toward a neutral position. At the same time, freedom of movement is restricted and essentially prevented between the boot and snowshoe relative to a third axis, the yaw or vertical axis. Several different structural arrangements are disclosed in several types of snowshoes, for achieving the second degree of freedom.

13 Claims, 19 Drawing Sheets

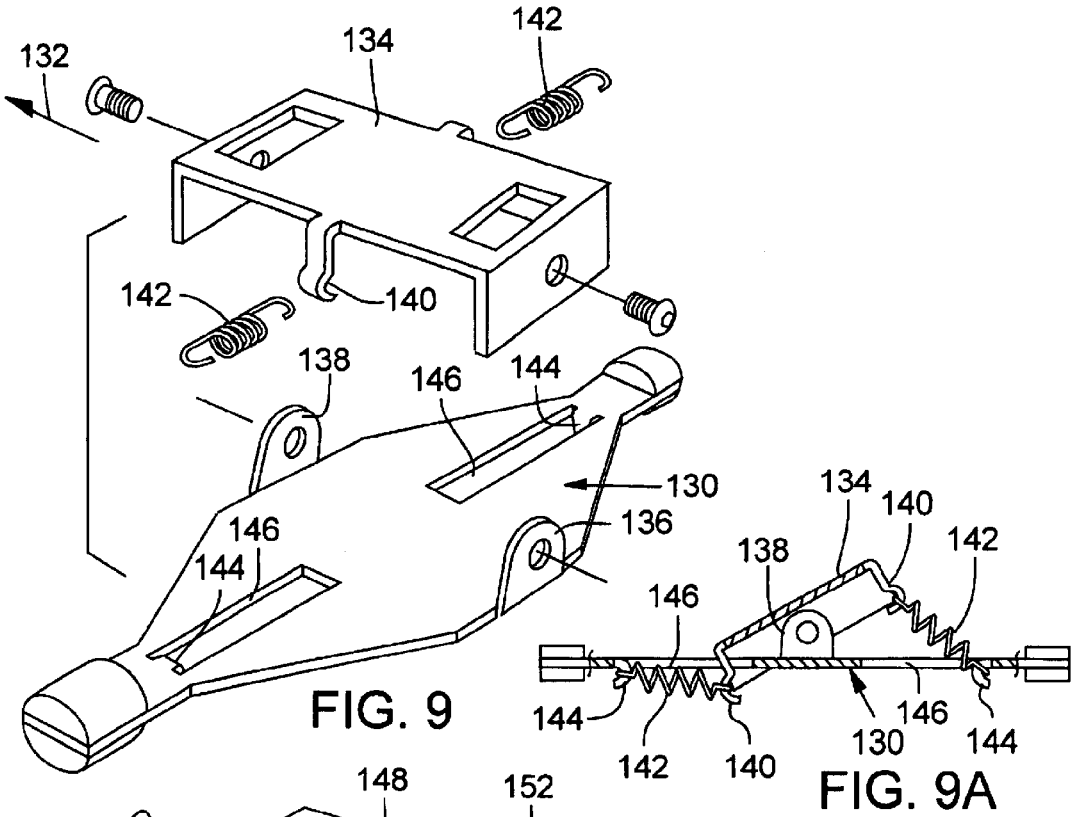
FIG. 9
FIG. 9A
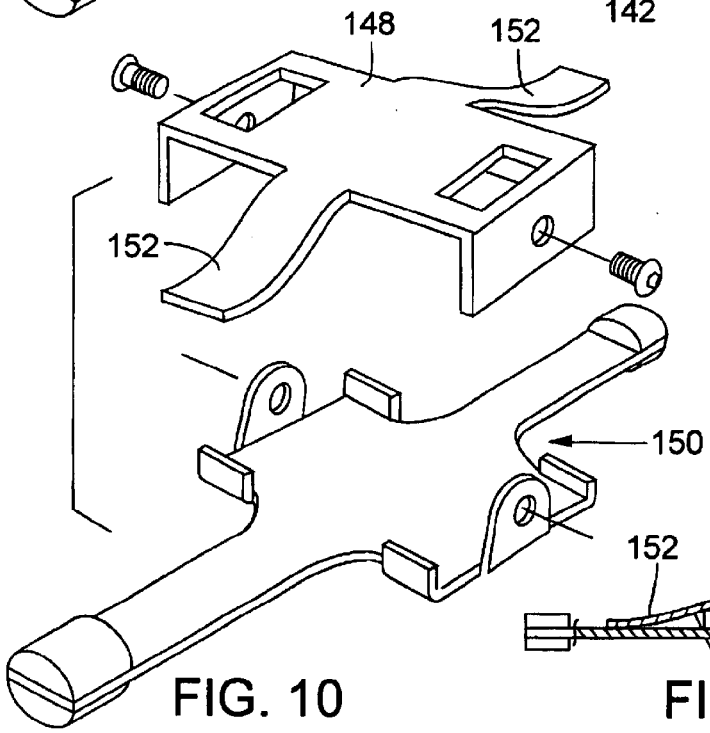
FIG. 10
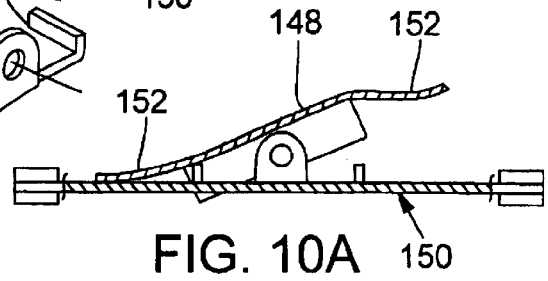
FIG. 10A

SNOWSHOE WITH TWO DEGREES OF ROTATIONAL FREEDOM

BACKGROUND OF THE INVENTION

The invention relates to snowshoes, and more specifically is concerned with the freedom of movement afforded between the user's boot and a snowshoe. The invention provides for addition of some rotational freedom about a roll axis, i.e., within a frontal plane, to make more comfortable, safe and convenient the traversing of hillsides where the snowshoe cannot be planted flatly on terrain.

A considerable number of snowshoes provide for freedom of movement of the user's foot and boot relative to the snowshoe on a pitch axis, that is, a traverse horizontal axis below the boot. This aids in walking over terrain where the user naturally tends to tip the foot, toe-downwardly, as the opposite foot is advanced and as the foot is lifted and moved forward, and avoids tripping the toe end of the snowshoe in the snow. Such pivoting has been achieved by supporting the boot footbed on support straps, as in Atlas Snow-Shoe Company's U.S. Pat. Nos. 5,440,827, 5,687,491 5,699,630, and 6,256,908; and has also been accomplished with simple pivot bars, as in U.S. Pat. No. 5,946,829, for example.

When traversing a side hill path, a snowshoe user needs another degree of freedom for comfort and safety in full terrain engagement—rotation about a "roll" axis, which can be described as rotation within the frontal plane. This should be a limited freedom of movement, with spring loading effective to return the snowshoe to the normal position and to resist the roll rotation of the snowshoe more strongly as the degree of roll rotation increases. Such a freedom of movement will allow the snowshoe to tip along the roll axis when the user plants the snowshoe down against terrain which is uneven and particularly, terrain which slopes from one side to the other. The snowshoe would therefore follow the terrain and be planted more firmly, while also increasing comfort and safety to the user and reducing ankle and foot stress.

U.S. Pat. No. 5,946,829 discloses a snowshoe which is aimed at the above goal. The snowshoe has a frame of a convoluted configuration, not contiguous in a closed loop around the frame, and in which inner members of the frame near the rear turn forward to form a flexible, spring-biased mounting by frame twisting that allows some degree of torsional freedom along the roll axis, i.e., in the frontal plane. That type of snowshoe frame has some disadvantages compared to the present invention described below.

SUMMARY OF THE INVENTION

The invention described herein achieves a second degree of rotational freedom, for movement within the frontal plane or about the roll axis of the snowshoe, in an efficient manner which still provides the benefit of a relatively simple and straightforward snowshoe design. This second degree of freedom is combined with the typically permitted rotation about the traverse or pitch axis, also preferably spring-biased toward a pre-selected "zero" position. At the same time, the configuration of the invention substantially prevents any rotation of the snowshoe in the yaw direction, about a vertical axis, which rotation would tend to be unstable and awkward and would cause discomfort and instability.

The two degrees of rotational freedom can be achieved in several different ways. As one example, the footbed of the snowshoe harness can have a mounting which includes a transverse horizontal pivot, preferably with spring-biased torsional resistance tending to return a pivot frame back to a prescribed relationship with the snowshoe frame. An additional pivot can be made between the footbed and the pivot frame, via a roll pivot axis at the middle of the pivot frame, permitting the desired rotation in the frontal plane. Leaf springs or a torsion rod can be used as a spring to bias this second degree of rotational freedom back toward the normal, undeflected position. Coil springs can be used for the zero-biasing of the footbed if desired.

Another configuration allowing two degrees of freedom uses strap suspension, somewhat similar to the front harness binding shown in the above Atlas Snow-Shoe Company patents. In this case, however, the support straps support a longitudinally extending rod or mounting device along a roll axis rather than supporting the footbed itself. The footbed is then secured to the rod or other pivot mounting so as to allow for the desired roll rotation. The rod can be a torsion rod, providing the needed bias. In this way, a simple support mechanism provides two degrees of spring-biased rotational freedom.

Another configuration for achieving the desired two degrees of freedom utilizes a pair of torsion arms secured to the normal peripheral snowshoe frame, these arms extending generally parallel to the snowshoe frame and to one another and being positioned just inwardly of the frame members. The arms have a tightly biased flexibility, such that if a torsion rod or pivot rod is connected between their forward tips, some degree of biased roll rotation is permitted. The rod extending between these arms provides the normal pitch rotation, and if this is provided as a torsion rod, the desired biasing is included.

A variation of the above is achieved in a molded snowshoe, preferably of fiber-reinforced plastic. Integrally molded arms extend in a forward direction within the snowshoe body, cantilevered from back ends of the arms. The front ends of the arms allow spring-biased roll freedom when a footbed is secured via these forward arm ends.

Another form of the invention has a snowshoe frame which can twist and rotate at certain points to allow footbed tilt relative to terrain.

It is therefore among the objects of the invention to provide a relatively simple and reliable connection between the user's boot and a snowshoe, whereby two degrees of freedom of movement of the snowshoe relative to the user's boot are permitted, these two degrees of freedom being rotation about the normal pitch axis and also about a roll axis, preferably with both axes biased toward a normal position. These and other objects, advantages and features of the invention will be apparent from the following description of Preferred Embodiments, considered along with the drawings.

DESCRIPTION OF THE DRAWINGS

FIGS. 9 and 9A are views generally similar to FIGS. 8 and 8A, but show a variation.

FIGS. 10 and 10A are exploded perspective and schematic sectional views showing a further variation of FIG. 8.

DESCRIPTION OF PREFERRED EMBODIMENTS

Figure 1:
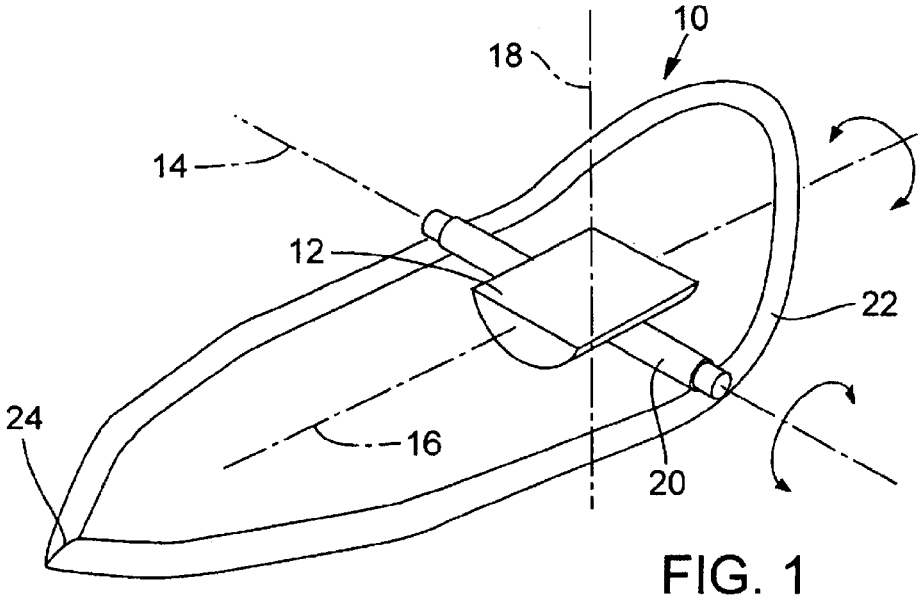
FIG. 1 is a schematic prospective diagram indicating possible degrees of rotational freedom in a snowshoe having a frame of conventional construction.

FIG. 1 indicates conceptually the framework and principles of the invention, showing potential rotational axes of a snowshoe relative to the user's boot, or to a footbed 12 to which the user's boot is secured. These axes of rotation, as mentioned above, are a transverse horizontal axis 14, or pitch axis, regarding potential rotation in the sagittal plane; the longitudinal horizontal axis 16 or roll axis, pertaining to rotation in the frontal plane; and the vertical axis or yaw axis 18, regarding rotation within a horizontal plane. This latter rotation is wholly undesirable and leads to instability in use of the snowshoe. Rotation about the yaw axis is to be avoided as nearly as possible.

A rotation about the pitch axis, within the sagittal plane, is desirable as discussed previously, and has been provided for in numerous previous snowshoes of Atlas Snow-Shoe Company and others. In the schematic perspective view of FIG. 1, this rotation is indicated as occurring via a bar or pivot pin 20 which permits rotation of the footbed 12 relative to the snowshoe frame 22. Such rotation has been provided on Atlas snowshoes via straps which secure the footbed to the frame, establishing the desired limited rotation and also a biasing force to return the footbed and snowshoe to a desired "zero" relative position. As discussed above, limited rotation about the roll axis is also desirable but has seldom been provided on snowshoes. U.S. Pat. No. 5,946,829 provides for some degree of rotation approximately on this axis, but this is accomplished via a special snowshoe frame which does not comprise a uniform peripheral frame 22 secured together at the rear (as at 24 in FIG. 1) as typical of frame and flexible deck type snowshoes. The cited patent may also provide for some rotation in the undesirable direction, about the yaw axis 18.

Figure 2A:
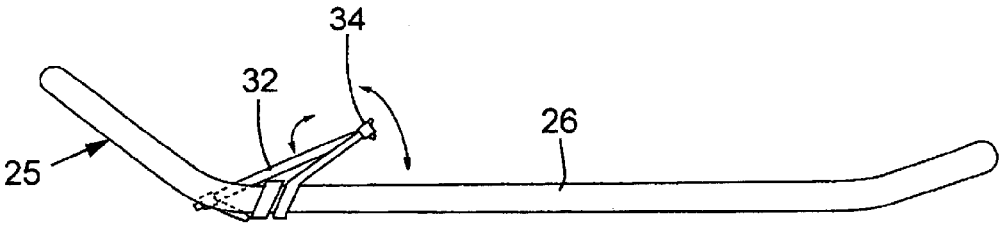
FIG. 2A is a side elevation view of the snowshoe of FIG. 2.
Figure 2:
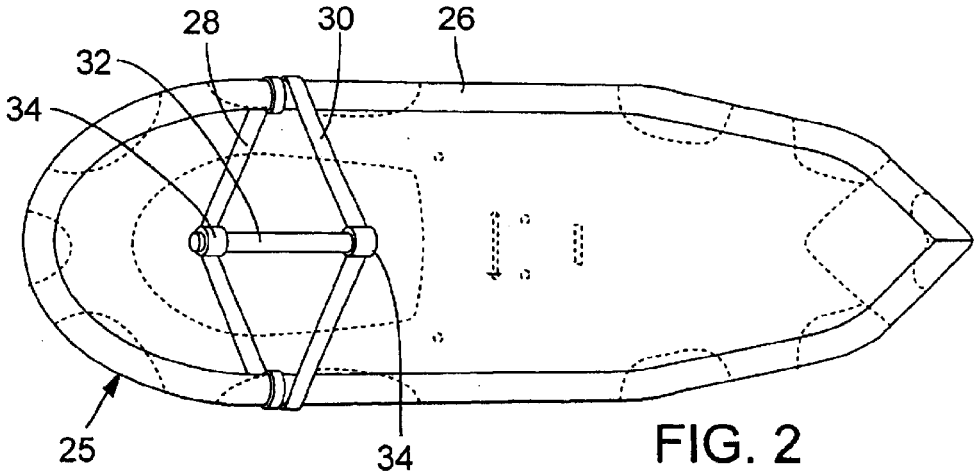
FIG. 2 is a plan view showing a snowshoe frame with one form of boot binding support affording two degrees of rotation of freedom, in pitch and roll directions.

FIGS. 2 and 2A show one embodiment of the invention for permitting the desired two degrees of rotational freedom without any substantial freedom of movement about the yaw axis. In this form of the invention, the snowshoe 25 has a snowshoe frame 26 about which straps 28, 30 are wrapped in the manner shown, which is similar to what is shown in Atlas Snow-Shoe Company U.S. Pat. No. 5,440,827, for example. These straps 28, 30 can comprise a single strap. In this case the straps are spread apart widely in the central portion of the snowshoe's boot harness area, for connection to a rod 32 as shown. See FIGS. 2 and 2A. The rod 32 may be rigidly connected to the straps 28 and 30, with the rod having torsional flexibility such that a footpad mounted near the center portion of the rod is afforded some degree of rotation along the center line of the rod. This provides the roll axis rotation described, preferably affording roll rotation of about 10° to 15° (or about 10° to 20°) each direction. Otherwise, the rod 32 can be mounted in bushings 34 at both ends, affording free rotation of the rod, with limitation to movement and biasing back to the "zero" position accomplished by other structure, such as coil or leaf springs.

FIG. 2A shows the snowshoe 25 in elevation, indicating that the rod 32 has a zero position in which it is inclined forwardly/downwardly, to establish the pitch-axis bias position such that the toe end of the snowshoe is urged downwardly.

FIGS. 2 and 2A show that the roll axis rotation (frontal plane rotation) of the snowshoe relative to the boot is achieved by rotation about the rod 32, while pitch-axis rotation (about the sagittal plane) is provided by the twisting of the binding straps 28 and 30, which effects a spring-like deflection of the snowshoe frame in the preferred situation in which the straps 28, 30 are not stretchable. Undesirable rotation about the yaw axis is resisted by the triangular geometry shown, by which the rod 32 is secured to the snowshoe frame via two triangles established with the straps 28 and 30.

Figure 3A:
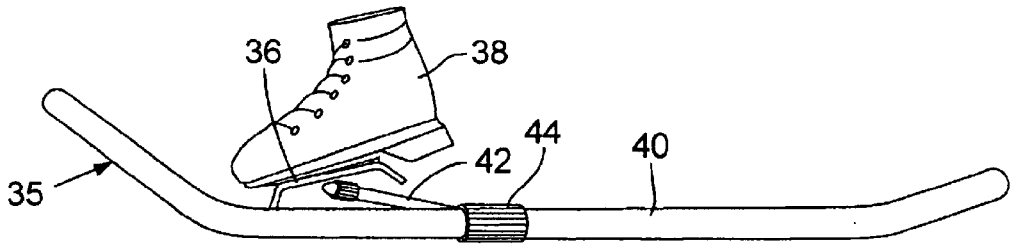
FIGS. 3 and 3A are plan and side elevation views showing another structural configuration for affording the desired two degrees of rotational freedom in a snowshoe.
Figure 3:
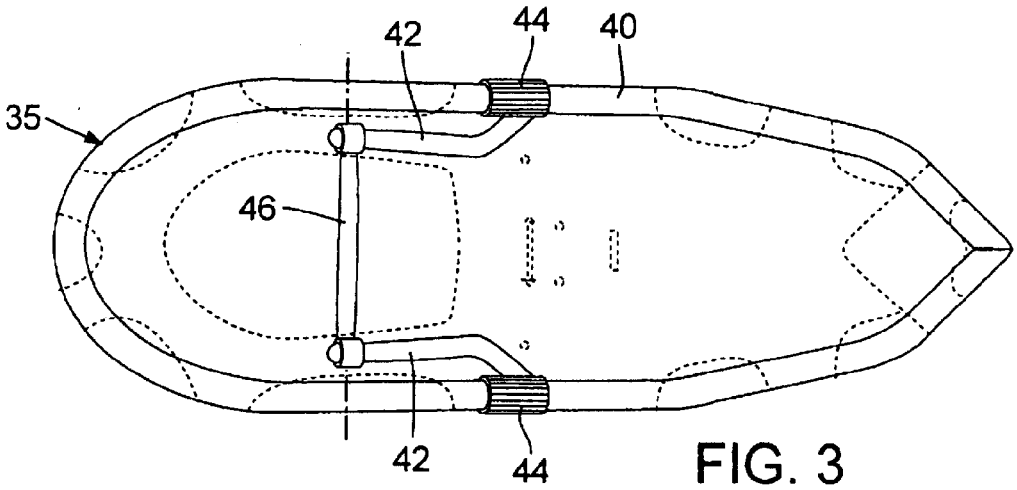

In FIGS. 3 and 3A, a snowshoe 35 supports a footbed 36 for a user's boot 38 in a different manner, but again achieving two degrees of rotational freedom, about the pitch axis and the roll axis. Here, the snowshoe frame 40 supports a pair of torsion arms 42 via frame joint inserts or collars 44 (or other mechanical means) rigidly connected to the frame. The torsion arms 42 can be of metal or reinforced plastic, capable of deflecting sufficiently to allow the desired degree of roll-axis rotation, with biased return to normal position. Note that the left and right torsion arms 42 can deflect independently. A pivot rod 46 secured to and extending between ends of the torsion arms allows sagittal plane rotation, about the pitch axis. This rod can be freely rotating relative to the arms, or constructed as a torsion rod and rigidly secured to the arms. The latter will provide a return force to the normal pitch position. This rod can be either metal or elastomer construction.

Figure 3B:
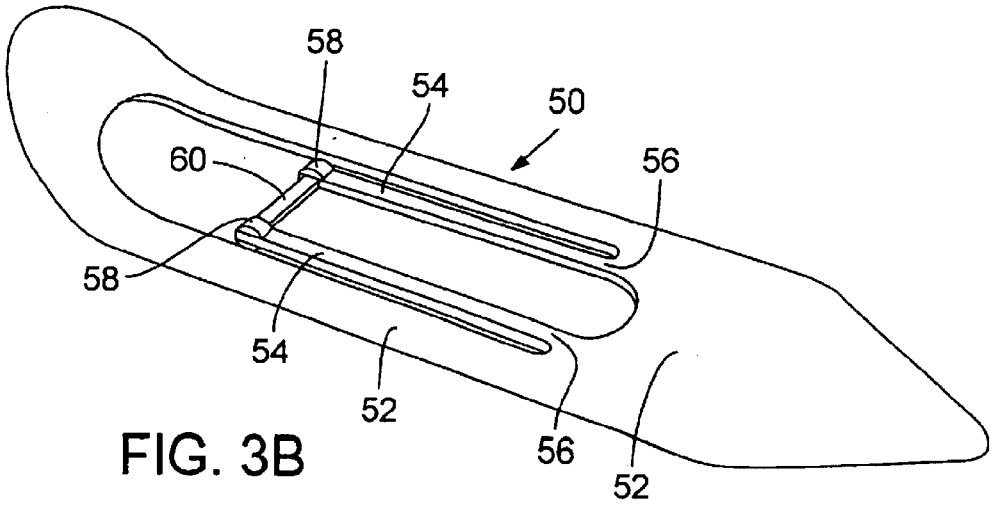
FIG. 3B is a schematic perspective view showing a molded snowshoe providing the desired two degrees of freedom, in a manner similar to FIGS. 3–3A.

FIG. 3B shows a variation of what is shown in FIGS. 3 and 3A, for a molded plastic composite snowshoe 50. In this case, the snowshoe has no peripheral frame in the sense of that provided in FIGS. 2–3A, and has no flexible decking suspended on such a peripheral frame, but instead the molded composite snowshoe 50 provides both a snowshoe decking 52 and, in essence, a frame which adds the needed rigidity (stiffener ridges can be included, not shown). The snowshoe 50 is integrally molded to provide a pair of torsion arms 54 which deflect angularly downwardly or upwardly and which function essentially the same as the torsion arms 42 in FIGS. 3 and 3A. As shown, the torsion arms 54 extend forward from integral connection areas 56 to forward ends 58 of the arms, where they support a transverse rod 60 which can be similar to what is shown at 46 in FIG. 3. The rod 60 can provide for pitch-axis pivoting, as in the earlier embodiment, and it can also be a torsion rod which provides the needed spring-like biasing force to return the snowshoe back to a desired normal pitch position relative to the binding or boot platform (not shown in FIG. 3B).

Figure 4:
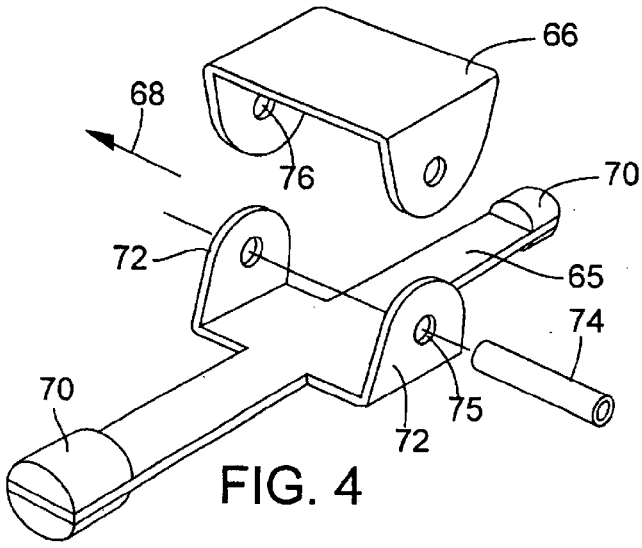
FIGS. 4 and 4A are an exploded view in perspective and a side cross sectional elevation view illustrating a pivot frame and footbed for implementing a further form of the invention to produce two degrees of rotational freedom.
Figure 4A:
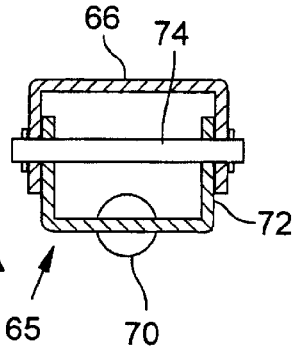

FIG. 4 shows another preferred embodiment for achieving the two degrees of rotational freedom in a snowshoe binding as desired. Here, the two degrees of rotational freedom are achieved by a pivot frame 65, to which is pivotally secured a footbed platform 66. The snowshoe and its frame are not shown in FIG. 4; the front of the snowshoe is generally to the left in FIG. 4 as shown by the arrow 68. The pivot frame 65 is secured to the snowshoe frame at end points 70, which may be by rigid attachment or via a pivot. If a rigid attachment, the pivot frame 65 acts as a torsion bar, providing for limited rotation about the pitch axis, within the sagittal plane, and providing a return force. The pivot frame 65 includes a central pivot support with upturned flanges 72 as shown, for receiving the pivotal footbed via a torsion rod 74. The torsion rod can be fixed to one of the flanges 72, at an aperture 75, as by welding, spline or other connection, and to the footbed aperture 76, on the opposite side. In this way, the footbed is supported for pivoting movement along the roll axis (in the frontal plane), and the length of the torsion rod 74 is available for twisting to provide the spring action tending to return the snowshoe to the "zero" position relative to the footbed and the user's boot. FIG. 4A shows this arrangement in a side elevation cross sectional view.

Figure 5:
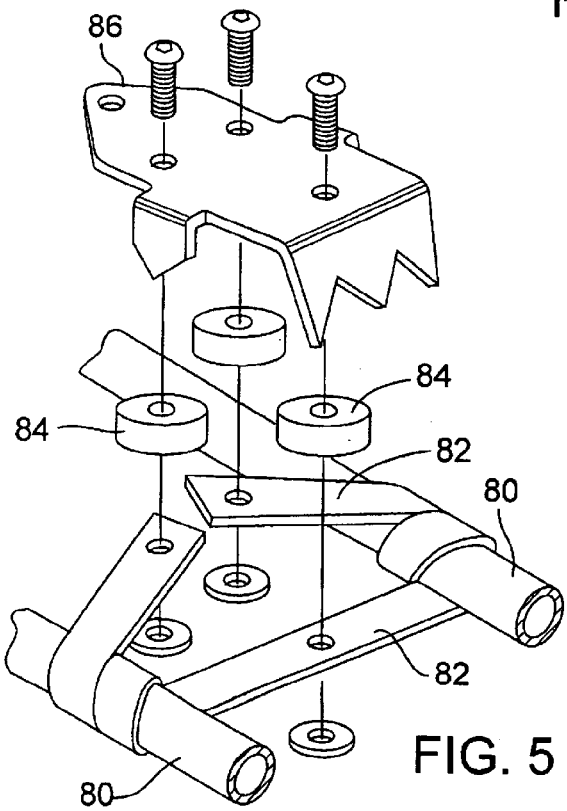
FIGS. 5, 5A and 5B are exploded perspective and sectional views indicating a further form of the invention, with FIGS. 5A and 5B showing flexing of the footbed within the second degree of rotational freedom.

FIG. 5 shows another configuration for achieving the same objective. In this form of the invention, a snowshoe frame 80 supports a binding strap or straps 82, in substantially the manner in which Atlas Snow-Shoe boot bindings have been supported previously for rotation along on the pitch axis, as shown, for example, in Atlas U.S. Pat. No. 5,440,827.

Figure 5A:
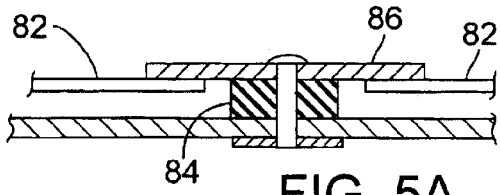
Figure 5B:
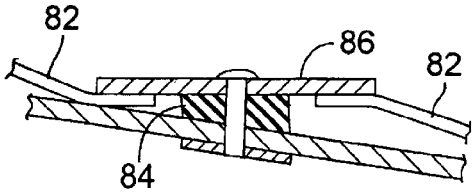

As shown in FIGS. 5–5B, the snowshoe in this embodiment achieves the desired second degree of rotational freedom about the roll axis through use of rubbery elastomeric bushings 84. The showshoe's front cleat 86, which also provides or is connected to a footbed for the user's boot, is secured to the binding strap or straps 82 via these elastomeric bushings 84 as indicated in the exploded view of FIG. 5. This provides for side to side tipping of the snowshoe, i.e. deflection about the roll axis, through deformation of the bushings 84. The transverse sectional elevation view of FIG. 5A shows the footbed/front claw 86 in the normal position, while the similar cross sectional view of FIG. 5B shows the footbed and the snowshoe in a position of maximum roll-axis rotation to one side. This allows the snowshoe to follow sloping terrain, i.e., a side hill condition, without overstressing the user's foot, ankle and leg.

Figure 6:
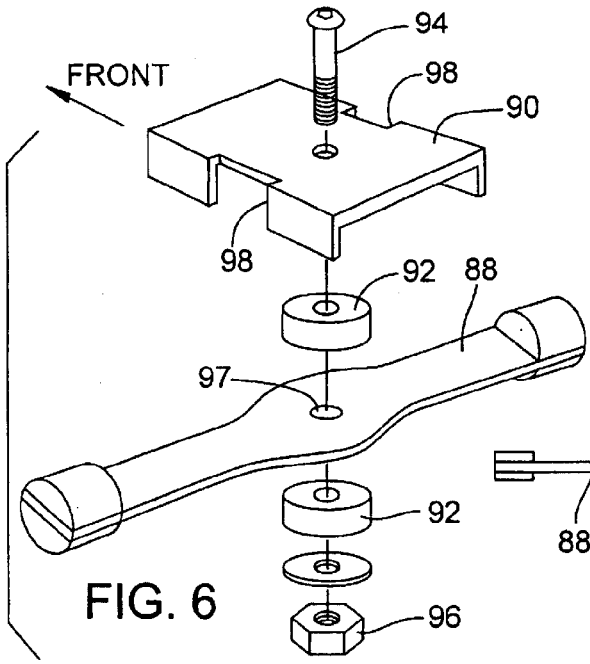
FIGS. 6 and 6A are additional exploded perspective and sectional schematic views indicating a further form of the invention for achieving two degrees of rotational freedom.
Figure 6A:
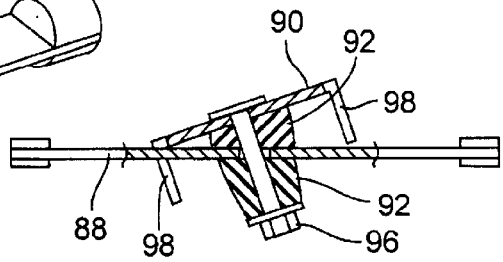

FIGS. 6 and 6A show another arrangement, essentially a variation of FIG. 5 and also incorporating some of the features of FIGS. 4–4A. In this arrangement, a pivot frame 88 is secured to the opposing bars of a peripheral frame (not shown), and this pivot frame can be mounted for rotation about the pitch axis (through the length of the pivot frame 88), with biasing restraint provided by appropriate forms of springs or other springable deflection devices, or the pivot frame can be fixed to the snowshoe frame, serving as a torsion bar as described relative to FIG. 4.

In either event, the footbed platform 90 of this assembly, which can also be a front claw as in FIG. 5, is secured to the pivot frame 88 by elastomeric bushings 92 as in FIG. 5. These are shown as being secured by a bolt and nut 94, 96, through a central hole 97 in the pivot frame. As an alternative, the bushings 92 could be replaced with compression springs.

FIG. 6A is a transverse cross sectional view showing deflection of the foot platform 90 about the roll axis, i.e., within the frontal plane. As shown in this schematic view, recesses 98 in the sides of the footbed 90 serve as rotation guides, these recesses riding over the pivot frame 88 and preventing yaw-axis rotation. The footbed platform 90 and pivot frame 88 are shown at maximum relative frontal plane rotation in one direction in FIG. 6A.

Figure 7:
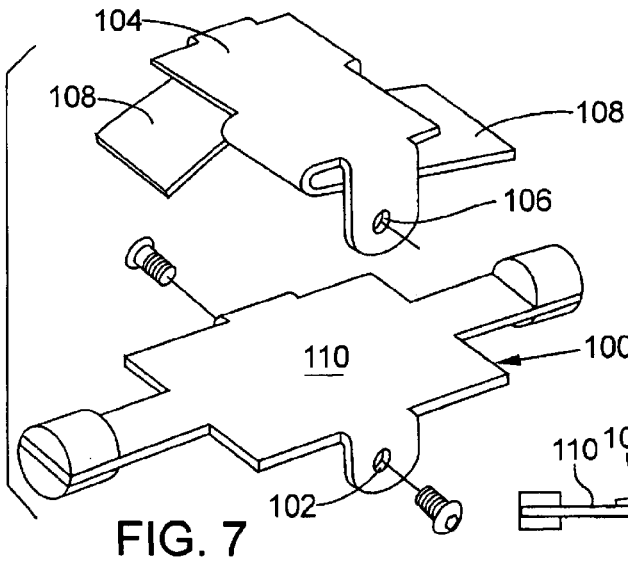
FIGS. 7 and 7A are further exploded perspective and cross-sectional views, indicating another variation of the invention for achieving the desired degrees of freedom.
Figure 7A:
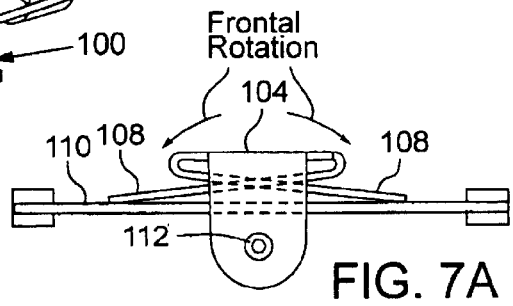

FIGS. 7 and 7A show another preferred embodiment of the invention, in a variation of FIG. 6. Orientation relative to the snowshoe is the same. In this arrangement the pivot frame 100 takes a different form, but still is secured to the snowshoe frame (not shown) in a manner as described above, but with pivoting connections at left and right.

Here, the pivot frame has pivot support flanges 102, on which a special footbed 104 is pivotally mounted via pivot ears 106. The footbed preferably is formed integrally of a single piece of metal, with left and right spring leaves 108 as shown. These, as indicated in the transverse sectional view of FIG. 7A, act as springs bearing down against the platform 110 of the pivot frame, tending to return the footbed platform 104 to the central, undeflected state about the roll axis 112 as shown in FIG. 7A.

Figure 8:
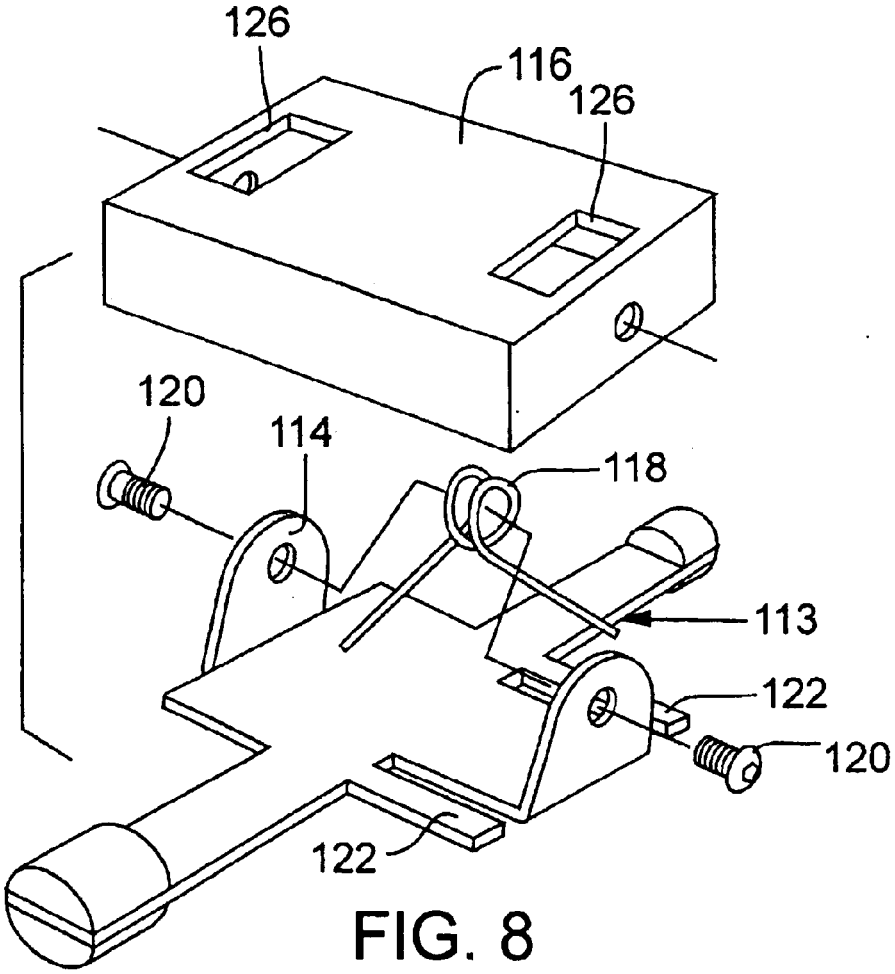
FIGS. 8 and 8A are exploded perspective and schematic cross-sectional views showing still another form of snowshoe footbed pivot arrangement according to the invention.
Figure 8A:
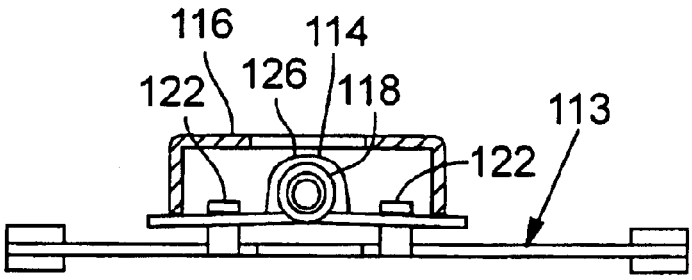

FIGS. 8 and 8A show a further variation on the basic operation of several of the previously described embodiments. The orientation of the components in FIG. 8 is the same as that in FIGS. 6 and 7, and FIG. 8A is a cross section similar to FIGS. 6A and 7A. Here, the modified pivot frame 113 (secured to the snowshoe frame, not shown, in a manner as described above) has a pair of upstanding pivot ears 114 to pivotally support a foot bed or foot box 116. This pivotal connection provides for rotation about the roll axis, similar to what is described above, but in this case the spring biasing toward the normal position is achieved in a different way. One or more coiled torsion springs 118 are secured about the pivot pin or rivets 120, so as to spring-bias the rotatable footbed or foot box 16 toward the centered position. One way of anchoring the ends of the spring 18 is to place them underneath each of a pair of frame-integral fingers 122 as shown in FIGS. 8 and 8A. The center 124 of the coiled torsion spring 118 passes around the rivet 120. On left or right tilting of the platform 116, one end or the other of the spring 118 is deflected downwardly.

The footbed or foot box 116 may be provided with holes 126, for access to the inner ends of the rivets 120 during manufacture.

FIGS. 9 and 9A show schematically another embodiment of a two degrees of freedom binding according to the invention, similar in principle to FIG. 8 but achieving the spring biasing force in a different way. In FIG. 9 a pivot frame 130 is somewhat similar to the frame 113 in FIG. 8, and may be secured to the snowshoe frame in the same manner as in generally similar earlier described embodiments. The front of the snowshoe is again to the upper left in the drawing, as indicated by the direction arrow 132.

In this form of the invention the footbed or foot box 134 is again mounted for roll-axis pivoting on pivot support ears 136 and 138 of the pivot frame. In this case, the foot box 134 has left and right spring mounts or connections 140, to which coiled tension springs 142 are secured. The opposite ends of these springs are secured to spring mounts 144 on the pivot frame, as indicated in FIG. 9 and as shown in the transverse sectional view of FIG. 9A. These tension springs are afforded movement by slots 146 in the pivot frame, and they are shown in a deflected position, at approximate maximum tipping of the footbed 134 relative to the snowshoe frame, in FIG. 9A. It is seen from FIG. 9 and 9A that the tension springs 142 tend to return the snowshoe and boot platform or footbed 134 back to a normal position of alignment.

FIGS. 10 and 10A show another variation on a construction similar to FIGS. 6 through 9, in which a footbed component 148 is again connected to a pivot frame 150. Here, the spring action biasing the footbed 148 back to normal position along the roll axis is provided by leaf springs 152 integral with the footbed or boot platform 148. The schematic transverse sectional view of FIG. 10A shows rotational deflection in one direction about the roll axis, in which the left leaf spring 152 is deflected and exerts a force tending to return the footbed 148 back to normal relationship with the pivot frame 150.

Figure 11:
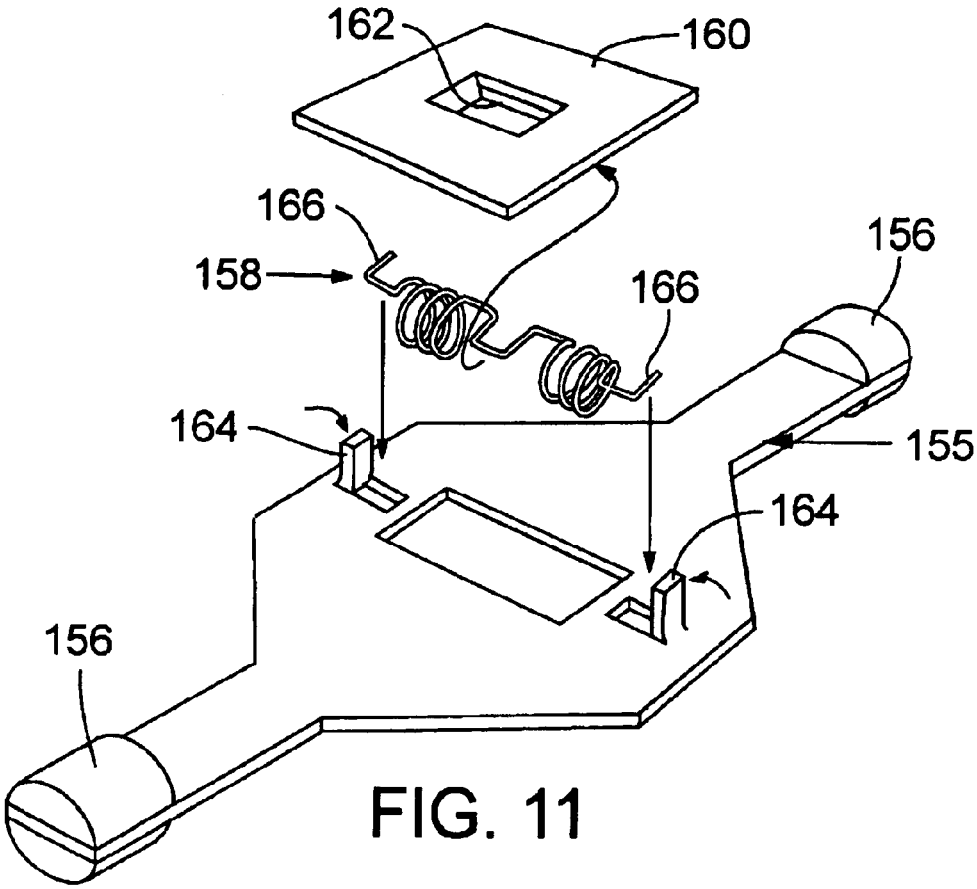
FIGS. 11, 11A and 11B are similar setup drawings showing a further variation.
Figure 11A:
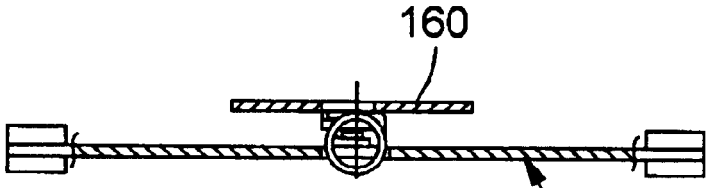
Figure 11B:
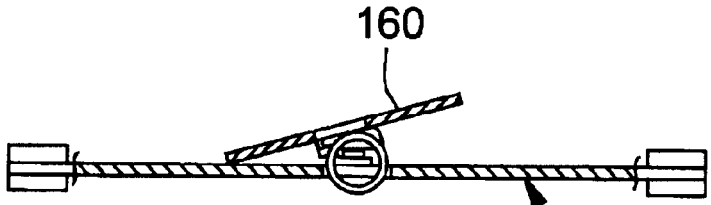

FIGS. 11, 11A and 11B show another scheme for achieving the second degree of rotational freedom, utilizing a pivot frame 155 which has ends 156 adaptable for securing to a snowshoe frame in the same manner as described for FIGS. 6–10. In this form of the invention, a coiled torsion spring and metal wire unit 158 provides the spring-biasing force to return a footbed 160 back to normal position, generally parallel to the pivot frame 155. The footbed 160 can have a stamped bridge 162 that is secured to the central area of the spring and metal wire component 158. This could be by welding, for example. The spring/metal wire element 158 is in turn connected to the pivot frame 155, and this can be via integral tabs 164 of the pivot frame that receive angled ends 166 of the metal wire element by. FIGS. 11A and 11B show undeflected and maximum deflected positions of the pivot frame 155 relative to the boot footbed 160. The spring/metal wire element 158 actually supplies the pivot for the footbed, not requiring an additional pivot rod. In the maximum deflected position as in FIG. 11B, the footbed edge engages against the pivot frame as a stop.

Figure 12:
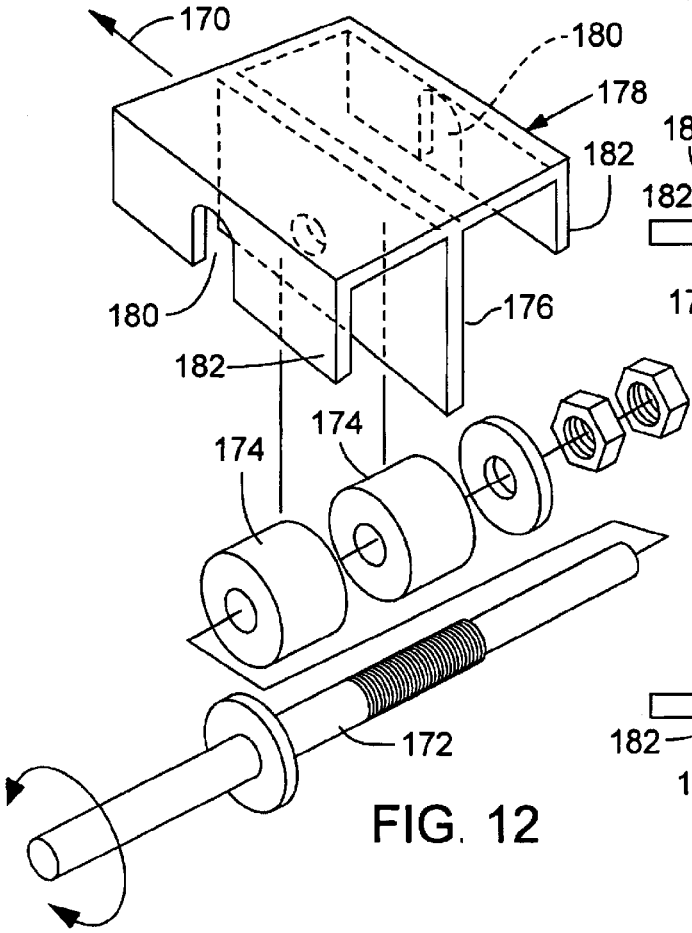
FIGS. 12, 12A and 12B are additional exploded perspective and cross-sectional views indicating another structural configuration of the invention for achieving the desired two degrees of rotational freedom.
Figure 12A:
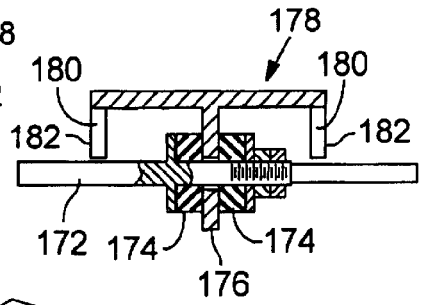
Figure 12B:
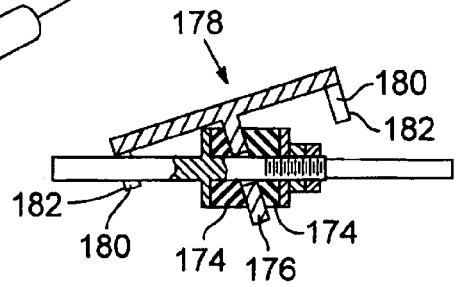

FIGS. 12–12B show another form of apparatus for obtaining the second desired rotational degree of freedom. The front of the snowshoe is again upper left as indicated by the direction arrow 170. The normal sagittal plane rotation (about the pitch axis) is achieved by a rod or pivot pin 172 extending across the snowshoe and connected to the frame. Pitch is controlled by an appropriate form of biasing spring or elastic element, not shown. The roll-axis freedom of movement is achieved in this case by elastomeric bushings 174 which engage against the vertical stem portion 176 of a generally T-shaped footbed 178. The elastomeric bushings 174 can be replaced by steel compression springs if desired. The assembled unit is shown schematically in FIGS. 12A and 12B, the first figure showing the footbed in undeflected position relative to the pivot rod 172 and the second figure showing full deflection to one side. The bushings (or springs) 174 make a sandwich with the planar footbed stem 176 and the elastomeric material is deformed elastically in FIG. 12B, allowing side tipping or roll-axis rotation between the footbed and the pivot shaft 172, which remains aligned with the snowshoe frame. As can be seen in FIGS. 12 and 12B, the footbed 178 has slots 180 in left and right depending flanges 182, and these are positioned to saddle the pivot rod 172. Thus, the slots act as guides for the footbed member when rotating about the roll axis, and they prevent undesirable yaw axis rotation, i.e. rotation within the generally horizontal plane between the user's boot and the snowshoe.

Figure 13:
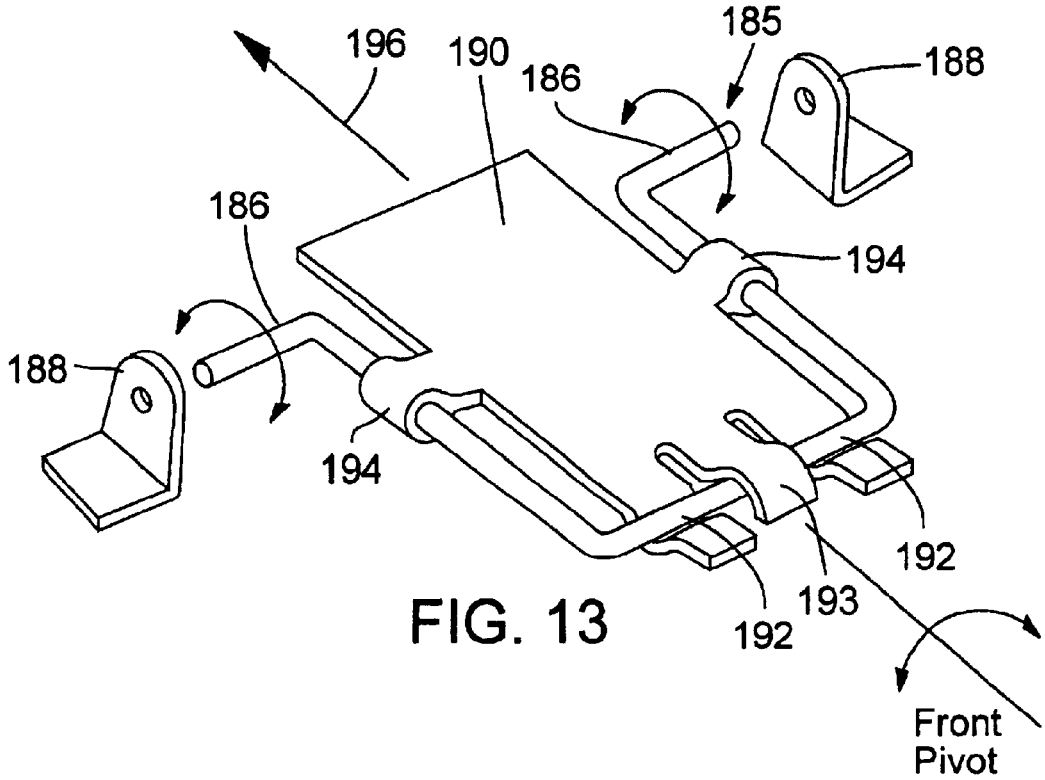
FIGS. 13, 13A and 13B are further exploded perspective and schematic sectional views, showing a further variation affording the desired degrees of freedom in accordance with the invention.
Figure 13A:
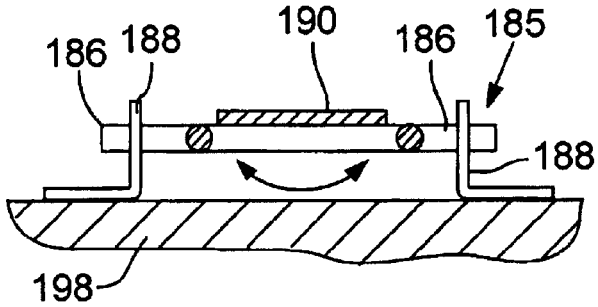
Figure 13B:
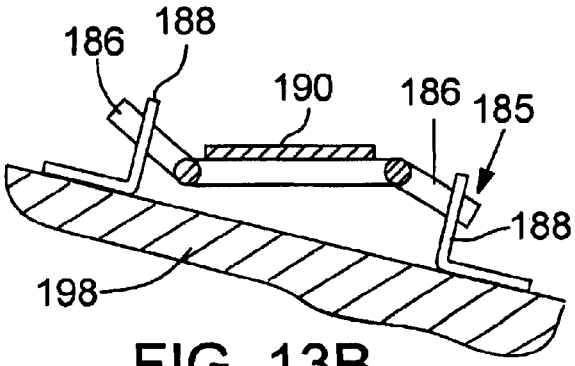

FIGS. 13–13B show another form of the invention for achieving footbed rotation about the pitch axis and the roll axis. In this arrangement, a bent torsion rod 185 provides for the usual pitch rotation, the rod having ends 186 journalled for rotation in bearing brackets 188 secured to the snowshoe, whether the snowshoe is formed of a frame with flexible decking or comprises a molded composite snowshoe. The rod 185 is fixed to a boot footbed 190 at a front or rear position, such as at points 192 and 193. At points 194 at left and right, however, the footbed has an integral sleeve connected around the rod but not fixed to the rod. This allows some twisting of the rod to afford some rotation about the roll axis 196 when needed, as shown in the transverse sectional views of FIGS. 13A and 13B. FIG. 13A shows the flat, undeflected position in which the entire rod and the footbed lie in approximately the same plane. In FIG. 13B the snowshoe 198 has been placed on uneven or sloping terrain, such as in a sidehill condition, and the snowshoe has tipped relative to the footbed 190. The rod 185 has twisted so as to allow the snowshoe's bearing bracket 188 to move downwardly while still being journalled onto the rod end 186.

Figure 14:
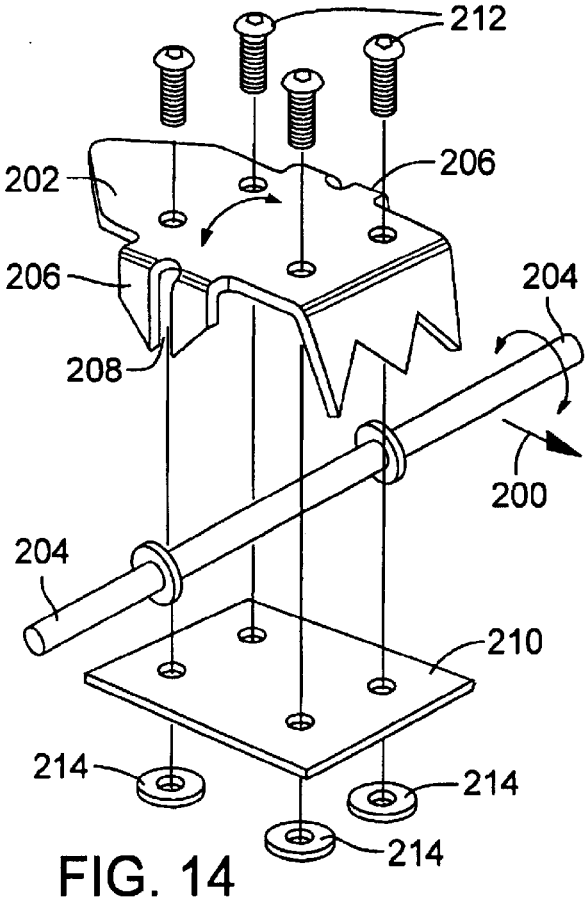
FIGS. 14, 14A and 14B are exploded perspective and schematic sectional views showing a further form of snowshoe footbed suspension providing the desired degrees of freedom.
Figure 14A:
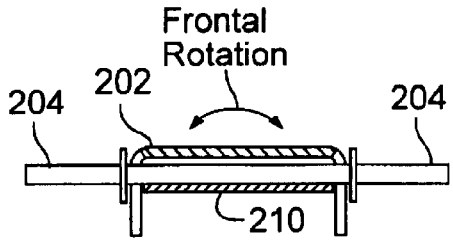
Figure 14B:
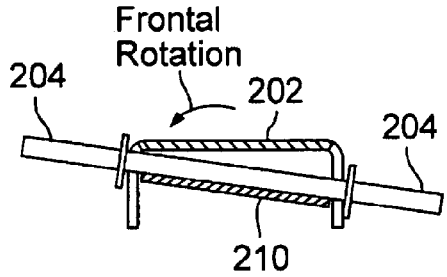

FIGS. 14–14B show another variation which is in theory quite similar to the embodiment of FIG. 12. In FIG. 14 the front of the snowshoe is to the lower right, as indicated by the arrow 200. A front claw and footbed 202 is secured on a pivot rod 204 which provides the normal sagittal-plane rotation (about the pitch axis), this rod being secured to the snowshoe for rotation and being biased toward normal in a manner as described above. The front claw/footbed assembly has integral side members 206 which include slots 208, these members also serving as claws in a preferred embodiment. As in the arrangement of FIG. 12, the slots 208 ride over the rod 204 and provide a guide for roll-axis rotation, also preventing vertical-axis (yaw) rotation. A stretchable membrane comprising an elastomeric pad 210 is assembled below the pivot rod 204 as shown in the exploded view of FIG. 14 and also shown in the schematic transverse elevation views of FIGS. 14A and 14B. Rivets 212 and rivet backing washers 214 secure this assembly together in a sandwiched arrangement. FIGS. 14A and 14B show that when roll-axis rotation occurs, the elastomeric pad 210 provides flexibility while still biasing the assembly back to normal position, thus the rod 204 (and snowshoe) is allowed to tip relative to the footbed 202.

Figure 15:
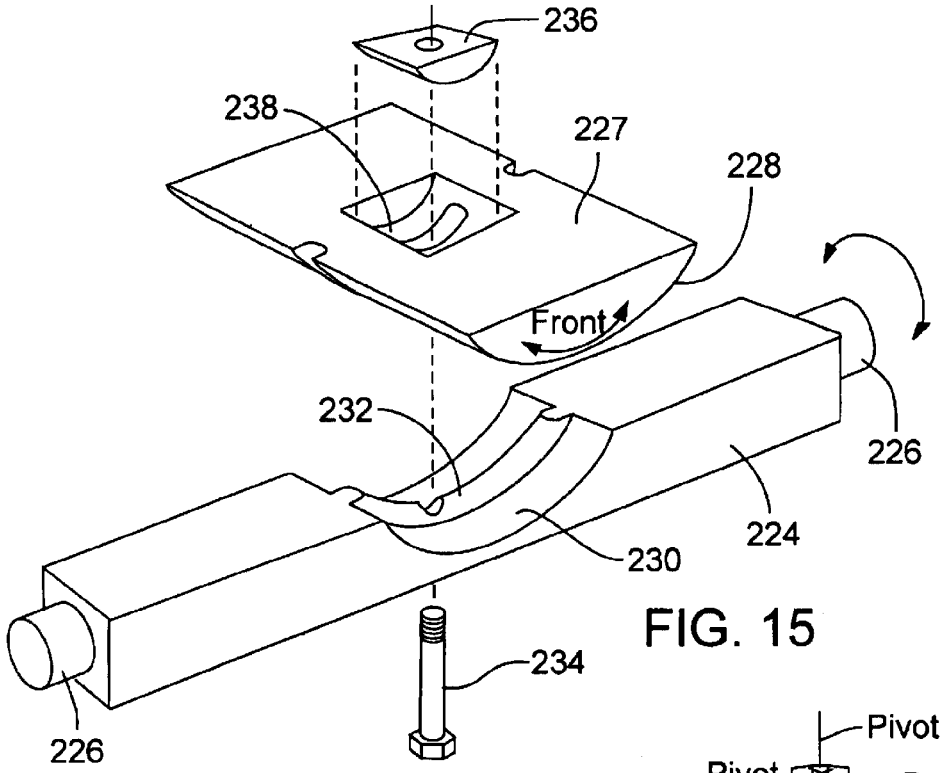
FIGS. 15, 15A, 15B and 15C are views showing a further variation of the invention, with FIG. 15C schematically indicating a desired level for the rotational axis of the second degree of freedom relative to the user's foot.
Figure 15A:
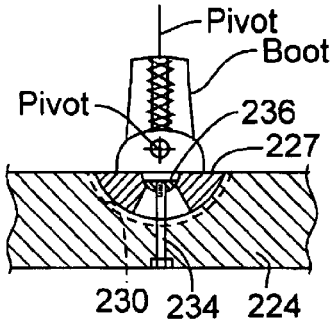
Figure 15B:
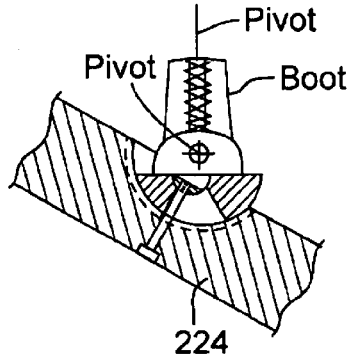
Figure 15C:
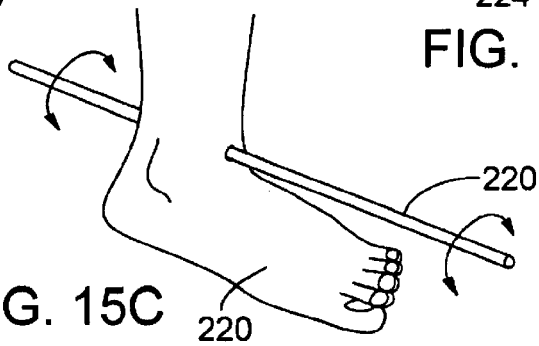

FIGS. 15–15C show another form of the invention and a different theory of pivoting. FIG. 15C shows a foot 220 and indicates the most desirable location for roll-axis pivoting, i.e. about a pivot axis 222 located approximately at the ankle. This is for maximum comfort and safety and minimum stress to the snowshoe user. This desired or theoretical pivot axis 222 is also seen in FIGS. 15A and 15B. In FIG. 15 a pitch-axis rotation member 224 somewhat similar to the pivot frames shown in earlier embodiments is secured for rotation on the snowshoe, via ends 226 of this component. The typical sagittal plane rotation is achieved in this way, and can be biased back to zero position by springs or elastomeric members. In this case, however, the roll-axis rotation is achieved via a footbed 227 having an arcuate bottom surface 228, for sliding or ball-bearing rotation in a concave arcuate saddle or recess 230 formed in the cross member 224. A bearing race can be provided at 232. To secure the footbed 226 to the cross member 224, a bolt 234 and special, arcuate-bottomed nut 236 can be provided, to seat in an appropriately shaped recess 238 on the upper side of the footbed 226. This provides for roll-axis pivoting about a high axis of rotation, approximately at the location 222 shown in FIGS. 15A and 15B, indicating normal position and sidehill position. Bias back to the zero position is not shown but could be achieved with springs.

Figure 16:
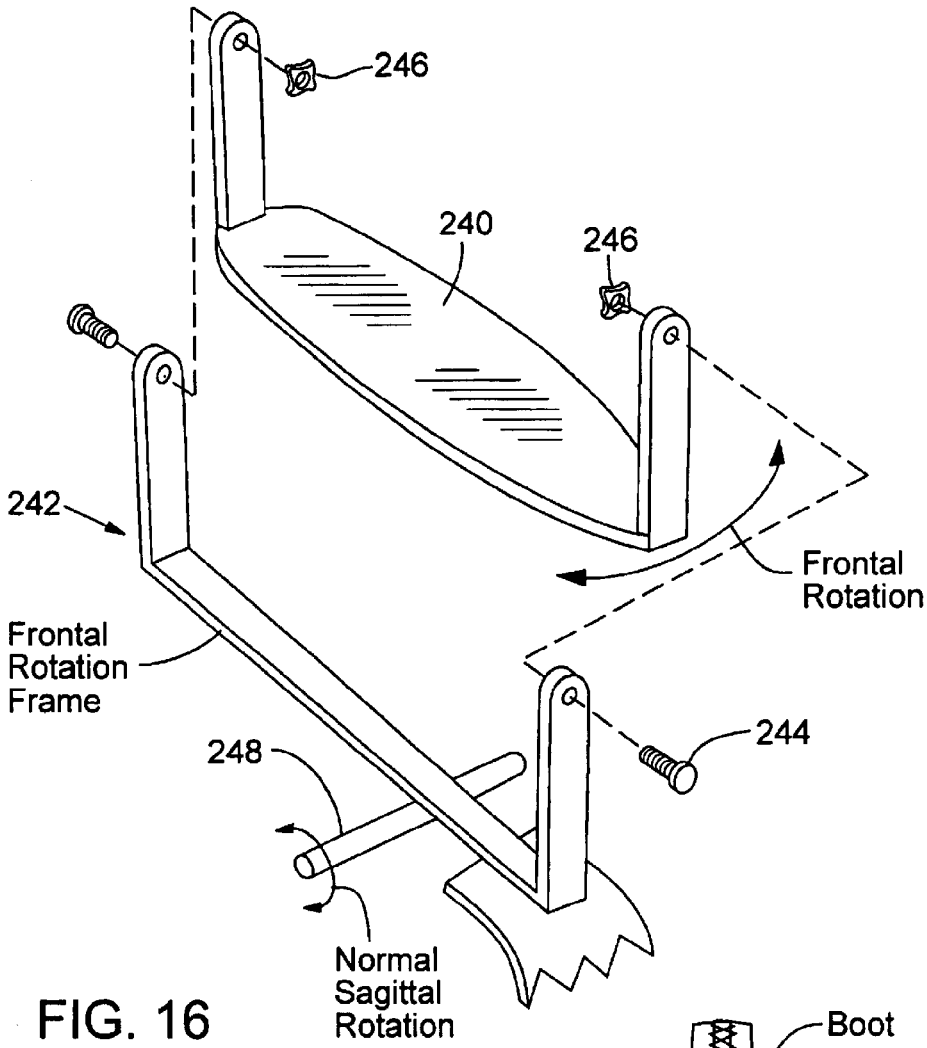
FIGS. 16, 16A and 16B show a further variation of a two-axis snowshoe footbed support, in this case providing the axis of the second degree of freedom at an approximate optimal location.
Figure 16A:
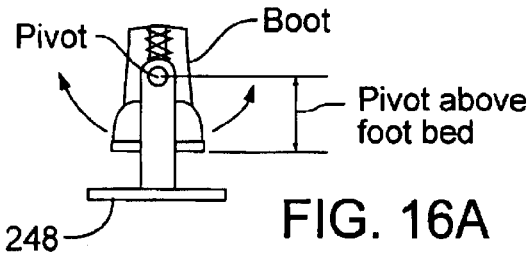
Figure 16B:
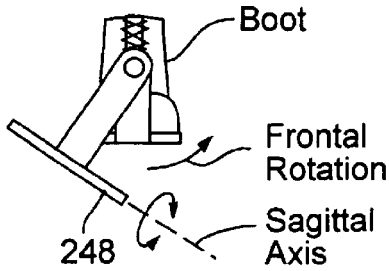

FIGS. 16–16B show another arrangement for providing a high axis of roll rotation, following the same theory as in FIG. 15. Again, the front of the snowshoe is down into the right in FIG. 16. A footbed frame 240 is connected to a frontal rotation frame 242, and this can be via rivets or bolts and nuts 244, 246. The user's boot is placed on the footbed 240 and, as shown in FIGS. 16A and 16B, the snowshoe is permitted to assume a tipped position for sidehill situations. A transverse rod or cross number 248, fixed to and a part of the frontal rotation plane 242, provides the typical pitch-axis rotation, in a manner similar to that discussed above. This snowshoe assembly thus provides for two degrees of rotational freedom with maximum comfort and safety to the user.

Figure 17:
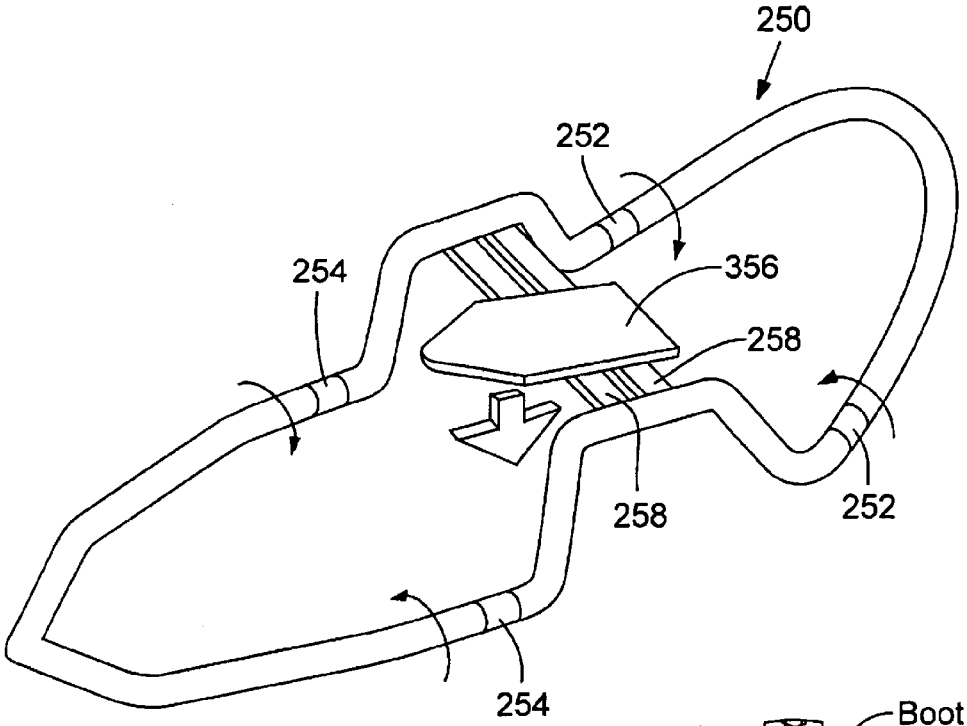
FIGS. 17, 17A and 17B show another variation, wherein a snowshoe frame provides for limited rotation on the roll axis.
Figure 17A:
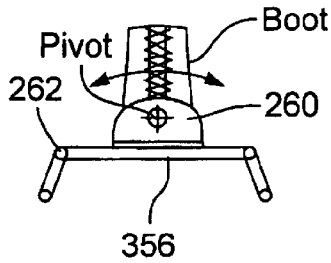
Figure 17B:
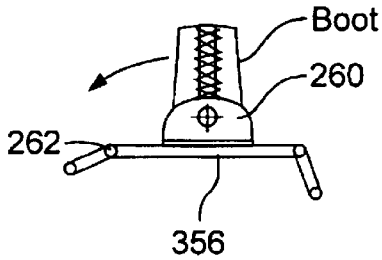

FIG. 17 shows the two desired degrees of freedom achieved in a different way. Here, a special snowshoe frame 250 is deformable due to inserted rotational connections at 252 and 254. These connections can include torsion bars as connectors, such that the aggregate snowshoe frame assembly is urged back to the normal position shown in FIG. 17. A footbed 256 is secured to this snowshoe frame via a rotational cross member or binding straps 258, preferably providing the usual pitch rotation. When the user walks on normal, flat terrain, the snowshoe frame remains essentially in the normal position as shown in the front elevation schematic of FIG. 17A. The user's boot 260 stays essentially parallel to the terrain and to the snowshoe. However, in FIG. 17B the user has encountered a sidehill situation, and the pivoted nature of the snowshoe frame allows the footbed to assume an angular position relative to the snowshoe and to the terrain. As indicated in these schematics, the footbed 256 is allowed pivoting movement at its connections at 262 to the frame, such as is permitted by binding straps 258. Thus, the snowshoe frame deflects and elastically deforms as indicated schematically in FIG. 17B, and this is reversed for the opposite sidehill situation.

FIGS. 18–28 show further embodiments of the invention for achieving two degrees of rotational freedom in a snowshoe binding.

Figure 18:
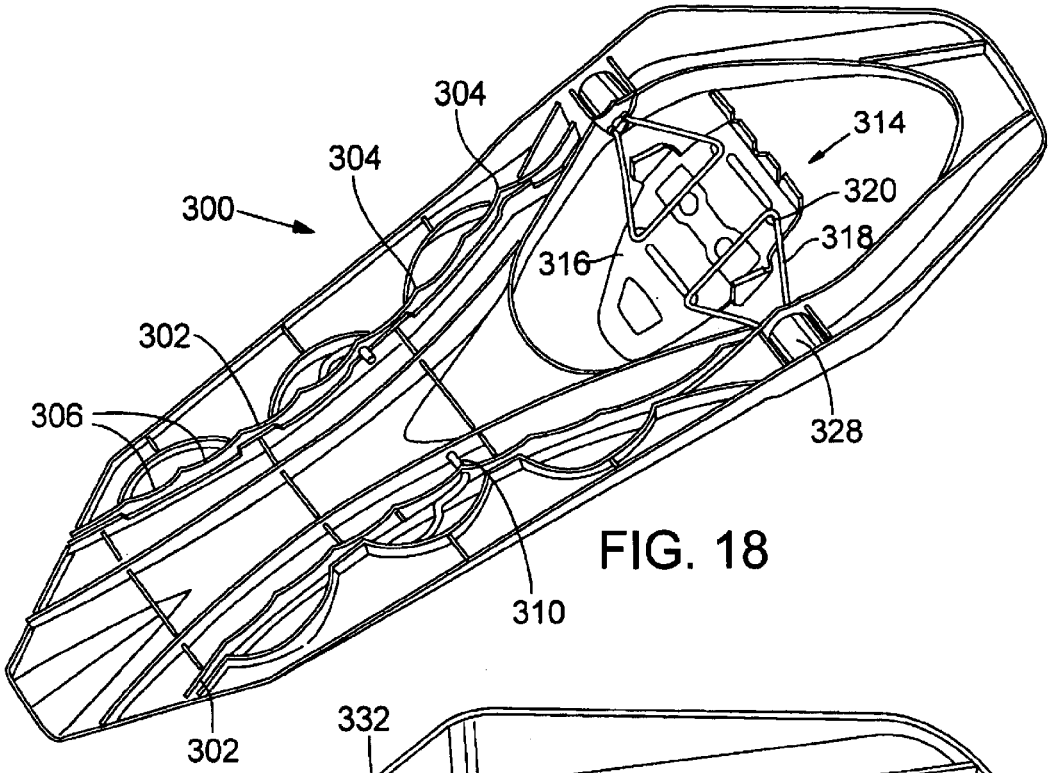
FIG. 18 is a perspective view from the bottom showing a molded plastic composite snowshoe having curved metal rails insert molded into the plastic material.
Figure 19:
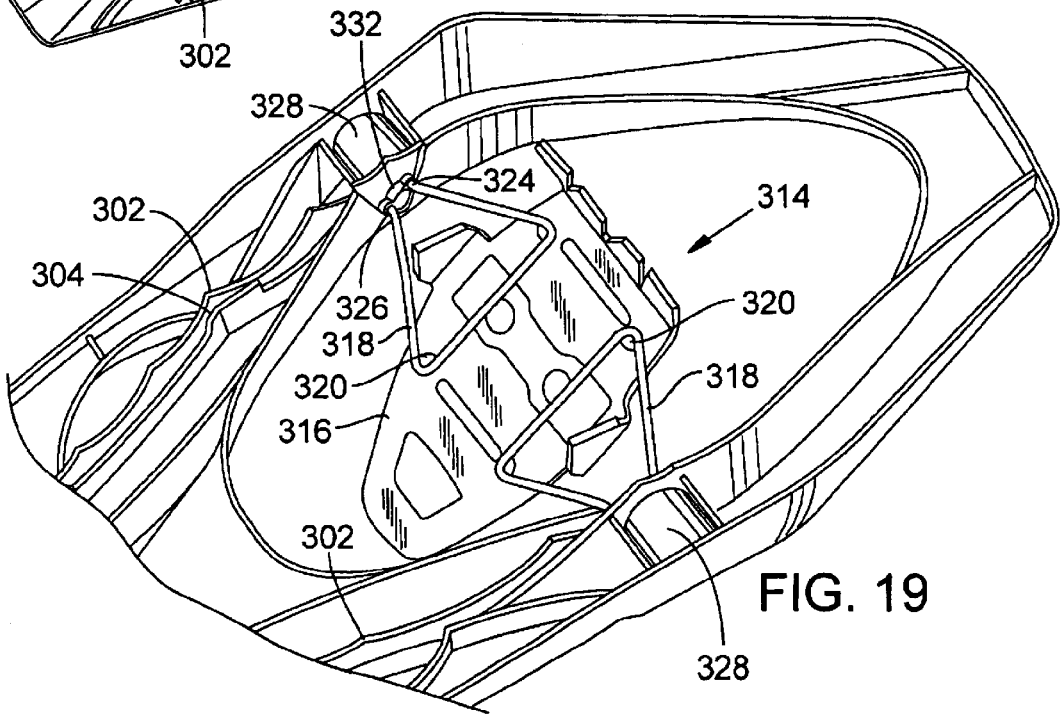
FIG. 19 is an enlarged view showing a portion of the snowshoe of FIG. 18, and indicating a footbed secured by WORD cables from the molded composite snowshoe body.
Figure 20:
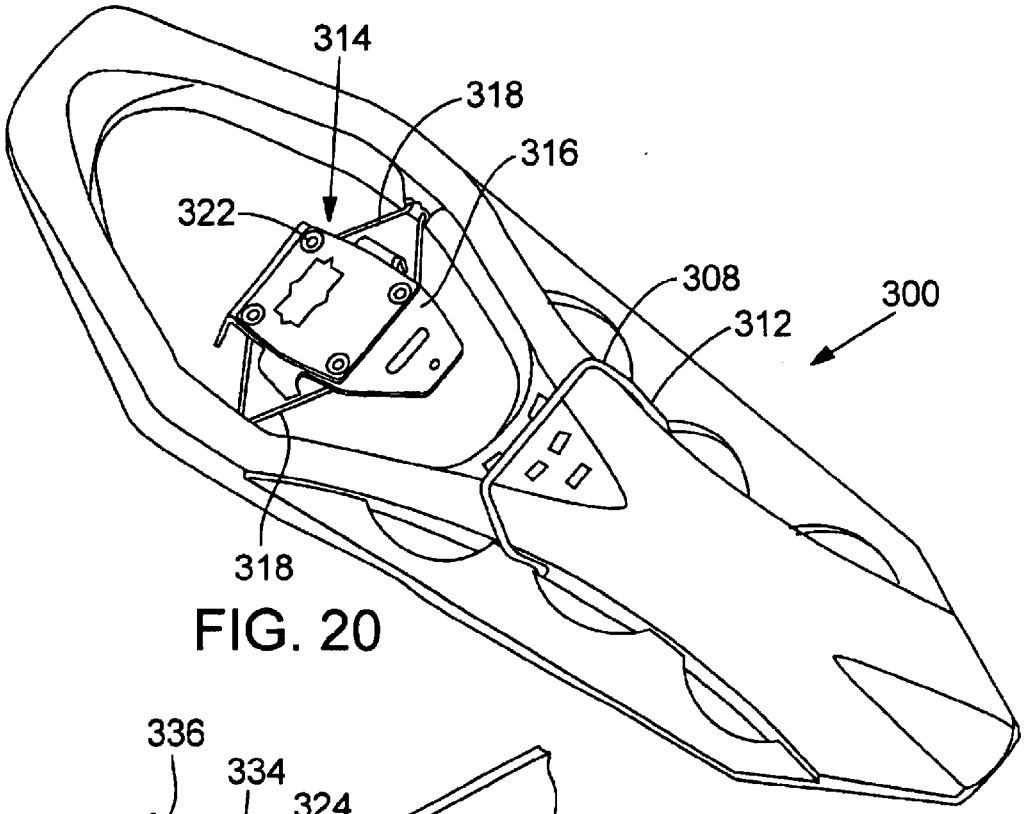
FIG. 20 is a perspective view showing the upper side of the molded composite snowshoe of FIGS. 18 and 19.

FIGS. 18–20 show a molded composite snowshoe 300, molded of a plastic material with fiber filling. FIGS. 18–20 are somewhat schematic, not showing all fasteners involved in order to reveal important components.

As shown in FIG. 18, the molded composite snowshoe 300 has a pair of terrain engaging rails 302 that are insert molded into the plastic material. These rails are metal, preferably of steel, such as stainless steel, and have a plurality of points 304 which act as teeth to engage the terrain. The rails may have a scalloped shape such that between the points 304 the shape of the rail bottom undulates in a curving fashion as shown at 306.

The metal rails 302 preferably have holes towards their upper sides, and these holes may be oval in shape, for increasing the bond with the plastic snowshoe molding by allowing the molten plastic material to flow through the holes. These holes are completely buried in the plastic and are not seen in the figures.

An important feature of the rails 302 is that they are curved. Each rail, as shown, has at least one curve, preferably curving inwardly toward the other rail and then back outwardly as shown in FIG. 18. In the illustrated embodiment the both ends of the rails have a short reverse curve just before the forward termination point of the rail. The main curvature in the rails is important for providing fore and aft traction on hard snow or icy terrain, in addition to lateral traction and torsional traction. In addition, the curving rails provide torsional rigidity along the longitudinal axis, resisting warpage about this axis.

FIGS. 18 and 20 show that the metal rails may also serve the purpose of providing a pivot attachment support for a heel lift 308. The heel lift, which is to lift the user's boot heel for steep uphill terrain, has inwardly bent ends 310 (FIG. 18) which pass through holes in the metal rails to provide the pivot support mounting. As is known, such a heel lift is normally flattened against the snowshoe deck (rotated clockwise as seen in FIG. 20), but is flipped up into the position shown in FIG. 20 when needed for steep terrain. The lift 308 can be moved forward to an "over center" position as shown, with elbows 312 resting against the snowshoe surface, to remain stable in the lifted position.

FIGS. 18–20 also show an important feature of the invention whereby a footbed 314 with metal front claw 316 is suspended by cables 318 secured to the claw and to the molded snowshoe body. The flexible cable 318, which can comprise aircraft cable, is secured to the front claw 316 in an appropriate sturdy and robust manner. As indicated in these drawings, the cable is preferably secured by fasteners through the illustrated holes 320 in the footbed. Fasteners 322 are shown in FIG. 20, but are omitted for clarity in FIGS. 18 and 19.

The cable binding suspension in FIGS. 18–20 is in a "diamond" configuration, in which the two cables on each side are spread apart widest at their connection to the footbed, and come close together as they enter the plastic snowshoe body. The cables are under high tension, as they support the weight of the user. In FIGS. 18–20, each cable enters the sides of the snowshoe, preferably passing through holes in the metal rails 302, in a spaced apart relationship as shown. A spacing may be only a few millimeters, or up to about one centimeter or somewhat wider. The purpose of the spacing, as just seen in FIG. 19, is to provide a spring-loaded bias to the angle of the footbed relative to the snowshoe binding, on the pitch axis. As in other snowshoes of Atlas Snowshoe Company, the footbed preferably is biased in pitch to a toe-downward position as shown, and this is achieved here by the orientation of the holes 324 and 326 through which the cable passes as it enters a spring enclosure 328 at each side.

As is seen from these drawings, the metal rails 302 provide considerable strength and rigidity for this cable binding arrangement, especially as the metal rails are insert molded into the plastic of the snowshoe body.

Figure 21:
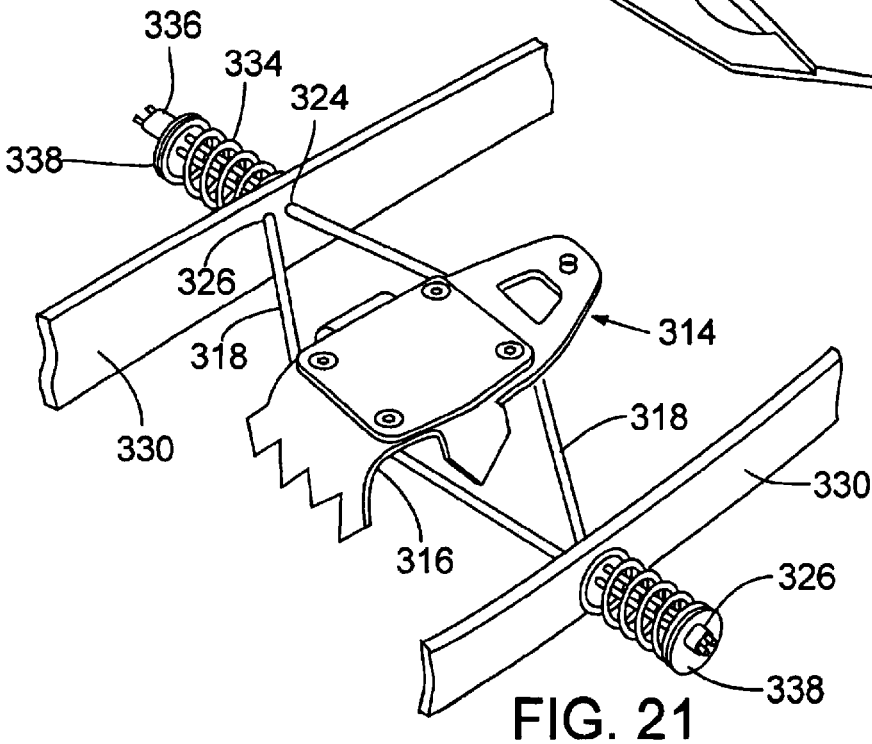
FIG. 21 is a schematic view in perspective showing a portion of a snowshoe and indicating a cable binding or footbed suspension in one embodiment.
Figure 28:
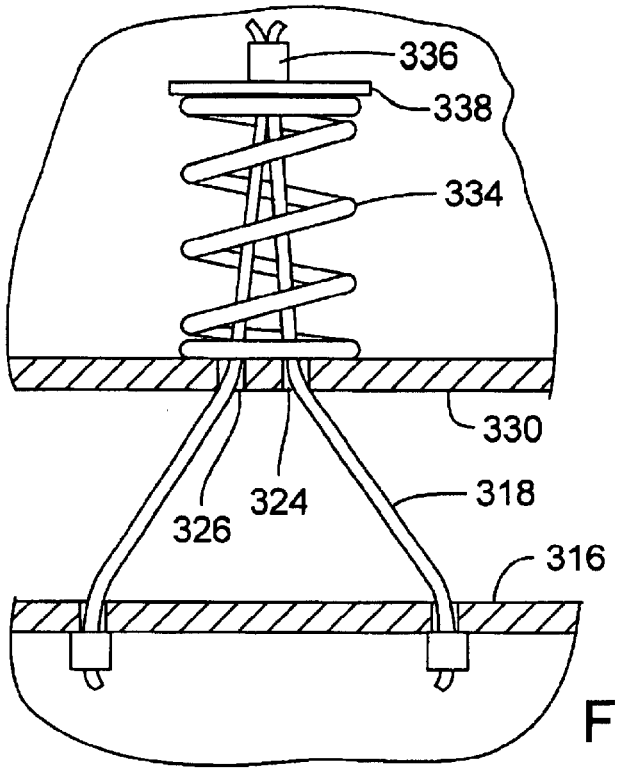
FIG. 28 is a schematic view showing a portion of a cable suspension to demonstrate the principle involved.

FIG. 21 and FIG. 28 illustrate the principle of operation of the cable binding arrangement shown in FIGS. 18–20. These drawings show that the cables 318 pass through the holes 324 and 326 and, on the other side of a wall 330 (which in FIGS. 18–20 is the rail 302), they are subjected to spring tensioning. At the holes 324, 326 the cables may pass through a cable guide or grommet 332 seen in FIG. 19, which may be of a tough and relatively low friction plastic material, or which could be of metal. The spring, as shown in FIGS. 21 and 28, preferably is a compression spring 334 (metal or elastomer), with the cables 318 passing through the coils of the spring 334 and being secured by an end connector, such as a cable crimp device 336 bearing against a washer 338. In FIG. 28 the footpad plate or base is schematically represented at 316, with a different form of connection than what is represented in FIGS. 18 and 19. In FIGS. 18 and 19 the spring 334 is shown as encased in a housing 328, although this is optional. In addition, a different type of spring can be used, such as a tension spring, and this could be encased within the housing 328.

Figure 25:
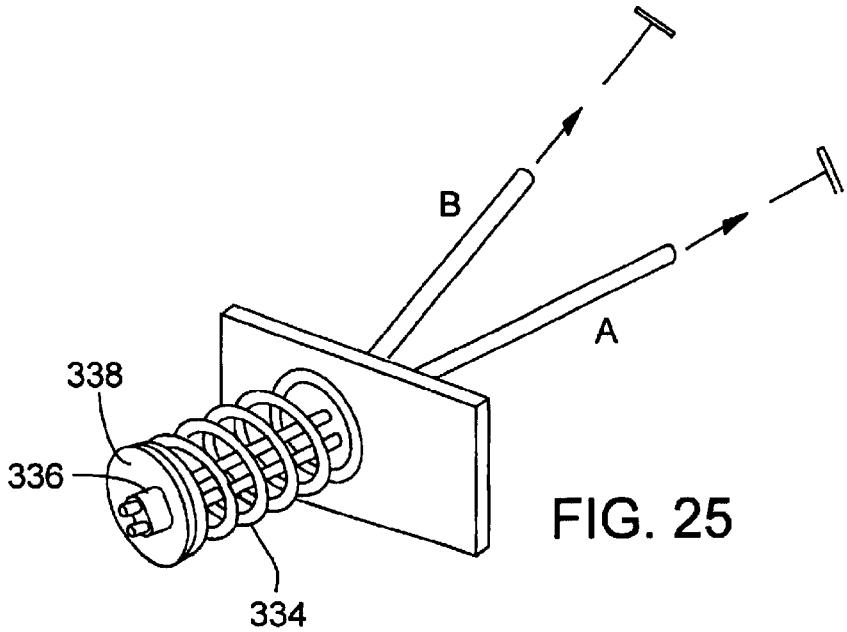
FIG. 25 is a schematic diagram in perspective, demonstrating resistance of cable binding embodiments of the invention to rotation about the yaw axis.

As can be seen from FIGS. 21 and 28, the essentially triangular of cables 318 tends to resist any rotation of the binding in the horizontal plane, i.e. about the yaw axis. FIG. 25 also schematically indicates this effect. Both cables A and B in FIG. 25 are linked together behind the spring, and they connect to the footpad at spaced apart locations, so that such undesirable rotation is resisted.

The illustrated binding suspension provides for rotation in the roll direction about a generally centered longitudinal axis. This is an important feature for comfort, efficient use of the snowshoe on cycle terrain, and prevention of ankle injury. If the pivot point for roll-axis rotation were at left or right, the function would be quite different. Thus, if the binding footbed 314 had a hard bottom position at left and right, but each side were allowed to tip upwardly when needed for sidehill terrain under the influence of a spring, this would not be center-axis roll rotation and would not have the benefits of the invention.

It is also seen from FIG. 21 that the holes 324, 326 through which the cables 318 pass can be spaced apart a greater distance to provide a more forceful return to the "zero" position of the footbed, since the farther these holes are separated the greater the cable-pulling force required to rotate the footbed in pitch. The holes can be aligned in an angled arrangement in the wall 330 to establish a bias pitch as discussed above, which may be in the range of roughly 10° to 30° with the binding footbed 314 toe-down relative to the snowshoe frame or body.

Figure 22:
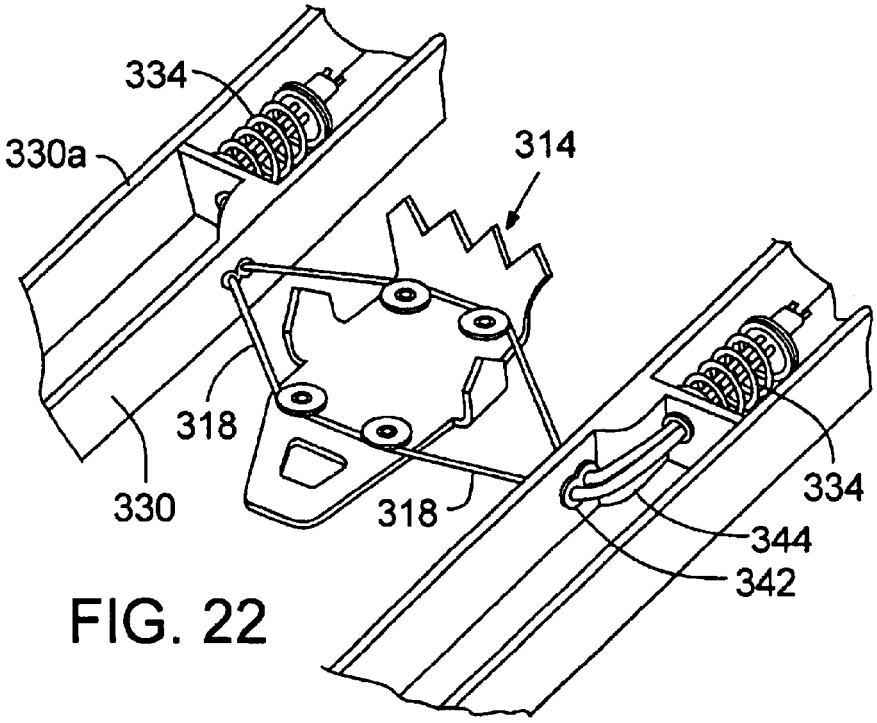
FIG. 22 is a bottom perspective view schematically showing a portion of a snowshoe and indicating another embodiment of a cable suspension.

FIG. 22 shows a variation of FIG. 21, wherein the cables 318 pass through holes in the snowshoe body wall and then pass through an approximate 90° turn so that the springs 334 can be housed in a greater longitudinal space. This requires low-friction grommets, as at 342, and low friction cable guards or pulleys as represented at 344. Again, the compression spring 334 can be a metal coil spring or an elastomer spring. As noted above, the cables can be tensioned by a tension spring if desired, rather than a compression spring as shown. A tension spring must be anchored at a distant end from the cables, and thus tends to require somewhat more space. Such space is easily provided via an arrangement similar to FIG. 22, although a sufficiently wide spacing between walls 330 and 330*a* in FIG. 22 can also accommodate tension springs.

Figure 23:
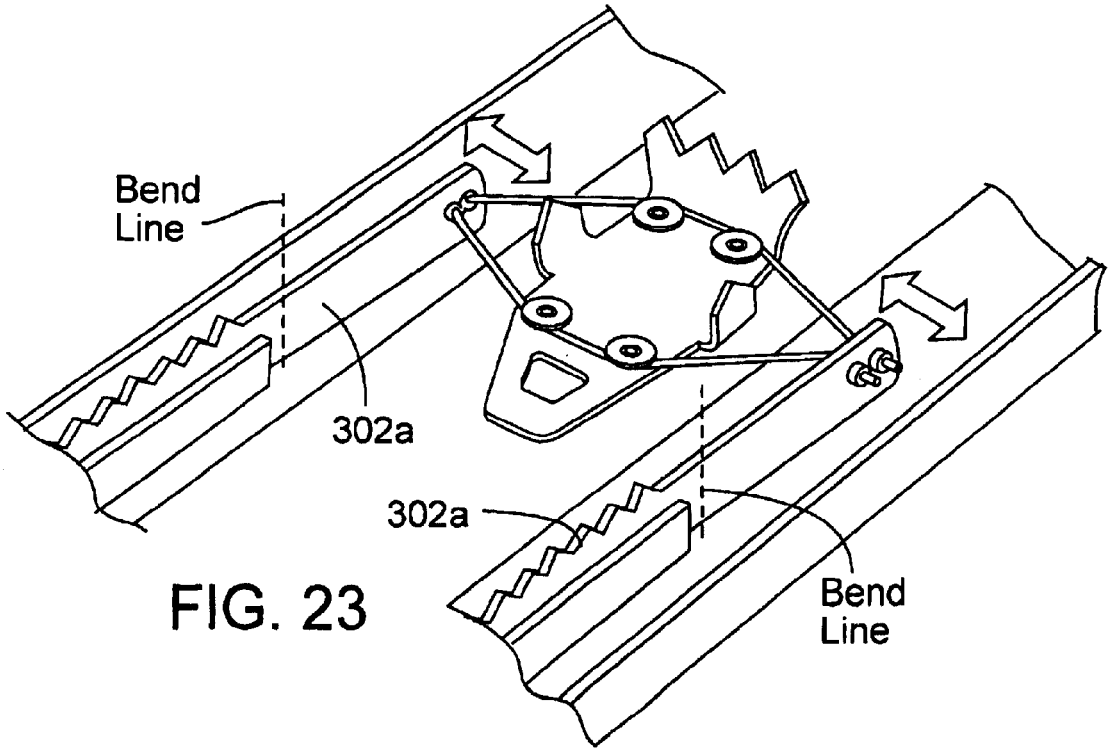
FIG. 23 is schematically similar to FIG. 22, showing a further embodiment.

FIG. 23 shows a variation of FIG. 21 wherein the spring force is provided by the metal rails 302*a* themselves. The rails 302*a* can be cantilevered from their insert mold areas as shown, so that a predetermined length of the metal rails (which may be of a spring steel) extends forward freely to form the cantilever. These cantilever springs could also be cantilevered plastic members.

Figure 24A:
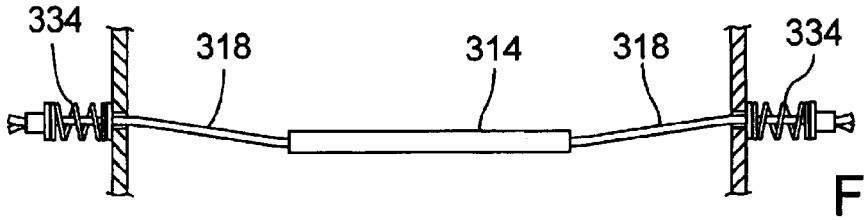
FIGS. 24A, 24B, and 24C are schematic diagrams indicating frontal plane rotation of the cable binding, i.e. rotation about a roll axis.
Figure 24B:
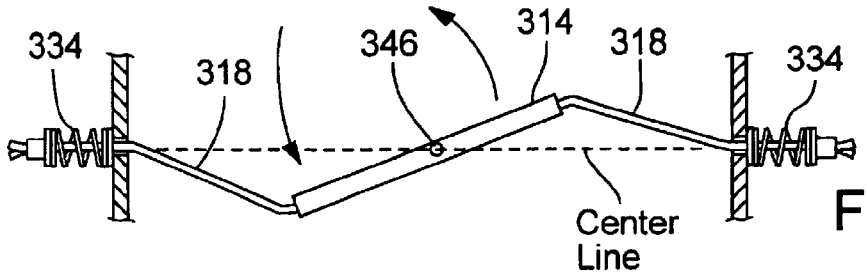
Figure 24C:
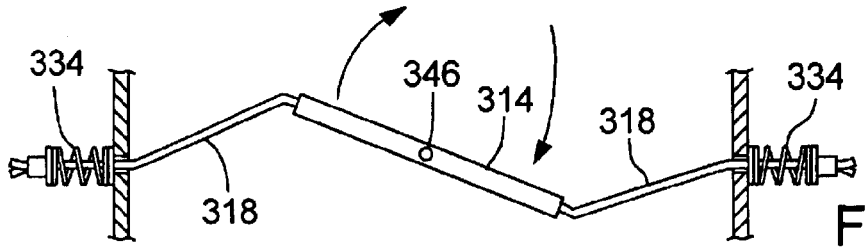

FIGS. 24A, 24B, and 24C demonstrate the rotation of the cleat-footbed 314 about the central roll axis as discussed above. In FIG. 24A, the cleat/footbed is shown schematically in a normal position, not on sidehill terrain. The springs 334 are somewhat compressed under the weight of the user bearing down on the cleat 314, and the cables 318 are shown slightly angled, approximately equally. In FIG. 24B the user has entered sidehill terrain and the cleat/footbed 314 is shown rotated in the counterclockwise direction relative to the snowshoe frame. This rotation is shown to occur generally about a central axis 346. If these are considered frontal views, the user has entered hillside terrain which slopes down to the user's left, the boot and cleat 314 remaining generally horizontal.

FIG. 24C shows the reverse situation, with the user on opposite sidehill terrain. Again, the springs 334 compress to accommodate rotation of the cleat/footbed 314 about a generally central axis 346. This roll rotation is also referred to as rotation within the frontal plane of the user.

Figure 26:
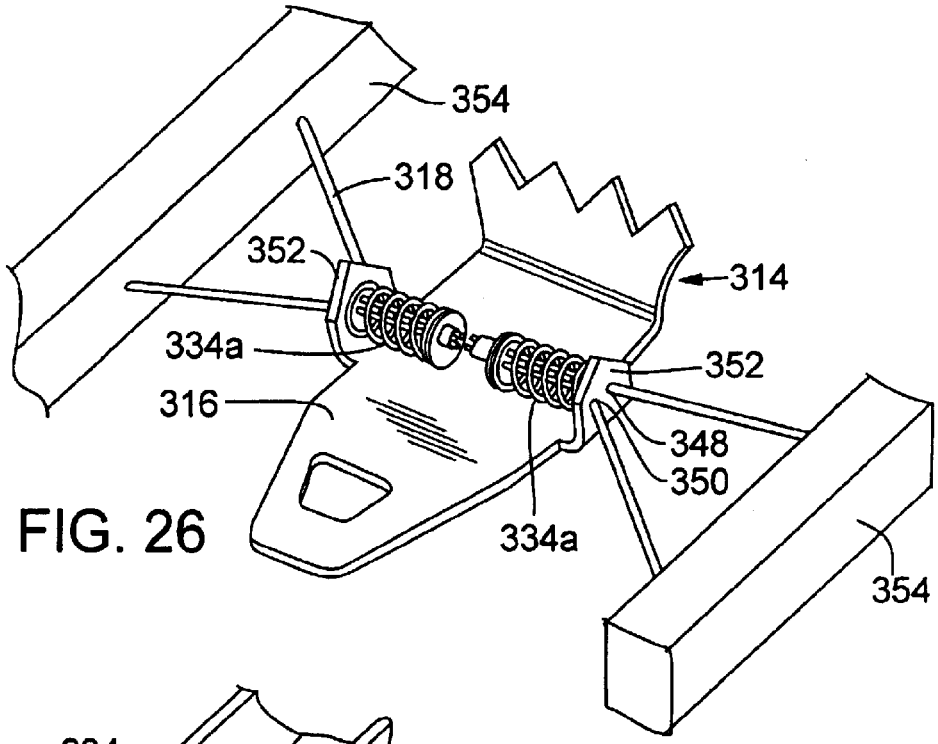
FIG. 26 is a schematic perspective view showing a portion of a snowshoe bottom and indicating a further embodiment of a cable binding or suspension.

FIG. 26 shows a variation in which the cables 318 are not in the "diamond" configuration described relative to FIGS. 18 et seq., but are generally in an "X" configuration. In this case the springs 334*a*, here shown as metal coil on elastomeric compression springs, are mounted on the cleat 316 of the footbed assembly 314. The cable holes 348, 350 may be provided through the side cleats 352 of the front claw or cleat 316 as shown, with the compression spring mounted immediately behind. The spacing and angular aligned relationship of the holes 348, 350 establish the strength of bias towards a normal pitch position, and the angle of bias of that normal pitch position. Here, the cables spread apart as they reach the rails or body 354 of the snowshoe. The snowshoe schematically depicted in this form of invention can be a metal rail or tubular frame snowshoe which supports a stretched decking, since the springs need not be accommodated in the peripheral areas of the snowshoe. Even the above embodiments can be incorporated on a tubular frame or rail type of snowshoe (rather than a molded composite snowshoe), but the location of the springs in the snowshoe periphery then tends to be somewhat more awkward.

Figure 29:
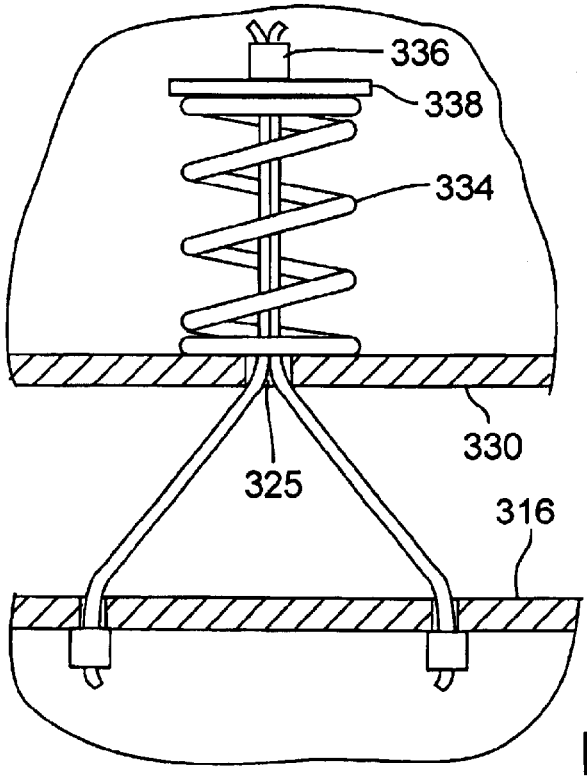
FIG. 29 is a schematic view similar to FIG. 28, but showing cables passing through a single hole.

The configuration shown in FIG. 26 can also be modified to a single-hole form of suspension, in which the holes 348, 350 are replaced by a single hole. As noted above, this does not provide for biasing the footpad to a prescribed "zero" pitch angle and allows essentially pre-rotation in pitch. The single-hole form is schematically indicated in FIG. 29.

Figure 27:
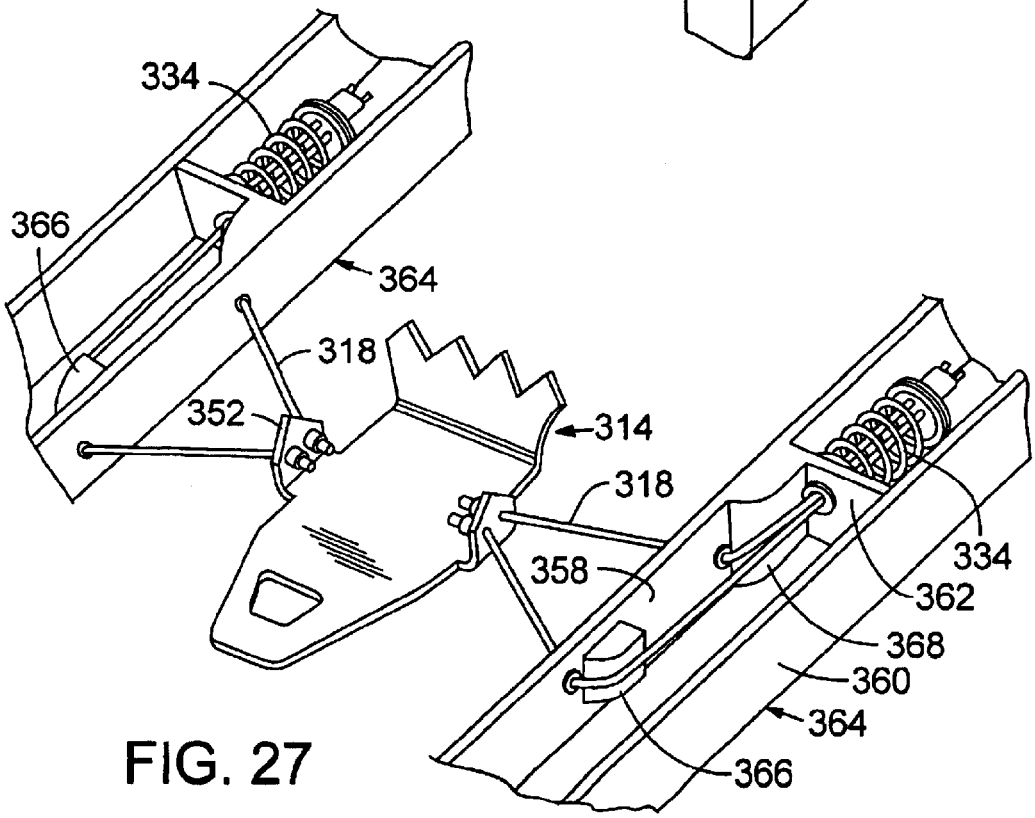
FIG. 27 is a perspective view similar to 26, indicating a further embodiment.

FIG. 27 shows another modification, again with the "X" configuration of cables 318, but in this case with the springs located in the snowshoe body in a manner generally similar to FIG. 22. The metal coil or elastomer compression springs 334, or tension springs, are shown positioned between molded plastic rails 358 and 360 of a molded composite snowshoe, with the spring located just beyond a bracing wall 362. Alternatively, the walls 358, 360 could be metal, as a part of a pair of metal rails 364. Again, as in FIG. 22, this arrangement provides additional space in the longitudinal direction for the spring, although low friction cable guides or pulleys are required at 366 and 368.

The above described preferred embodiments are intended to illustrate the principles of the invention, but not to limit its scope. Other embodiments and variations to this preferred embodiment will be apparent to those skilled in the art and may be made without departing from the spirit and scope of the invention as defined in the following claims.

We claim:

1. A snowshoe providing two degrees of rotational freedom of a user's boot relative to the snowshoe, comprising:

a snowshoe frame comprising a unitary peripheral element which extends from a nose area of the snowshoe back to a tail end of the snowshoe, the frame being contiguous and forming a closed loop around its periphery, a boot platform, and suspension means secured to left and right sides of the frame and positioned within the frame, for securing the boot platform to the frame with two degrees of rotational freedom, one degree of freedom being about a pitch axis and the second being about a roll axis, with the boot platform being resiliently biased toward a neutral position on both axes, such that a user's boot can flex rotationally about the two degrees of rotational freedom when walking on uneven terrain, and the suspension means substantially preventing rotation of the snowshoe relative to the boot about a generally vertical axis, and decking supported by the snowshoe frame for engaging terrain.

2. The snowshoe of claim 1, wherein said neutral position comprises, on the pitch axis, a toe-down angled position of the boot platform relative to the snowshoe frame.

3. The snowshoe of claim 1, wherein the suspension means comprises flexible tension lines connected to the frame and to the boot platform.

4. The snowshoe of claim 3, wherein the tensioned lines, at each side of the boot platform, comprise tension line sections spaced apart at their connections to the boot platform and converging closely together at the snowshoe frame, and spring means connected to the frame for applying tension to the tension line sections.

5. The snowshoe of claim 4, wherein the tension line sections reach the snowshoe frame in a spaced apart relationship, the two tension line sections having ends which are pulled by the spring means, and the tension line sections passing through holes in a section of the snowshoe frame in said spaced apart relationship, whereby the spring tension and the spacing at the frame between the two tension line sections establishes a neutral position about the pitch axis, to which the boot platform is urged by the spring means.

6. The snowshoe of claim 5, wherein the neutral position is a toe-downward angled position relative to the snowshoe frame.

7. In a molded plastic snowshoe, a pair of bottom rails on the snowshoe, the rails extending downwardly for engaging terrain and extending generally in the snowshoe longitudinally but curving from front to back, the rails being discrete and separate and not connected together, whereby the rails provide forward/aft traction as well as lateral traction, and add rigidity to the molded showshoe, and wherein the rails are metal and are insert molded into the molded plastic.

8. The snowshoe of claim 7, wherein the rails have a series of bottom apex points for increased traction on firm snow or ice.

9. The snowshoe of claim 7, wherein the metal rails extend generally longitudinally and in spaced apart relationship in the snowshoe, but curve inwardly toward one another in an intermediate area, then back outwardly away from one another, toward the back of the rails.

10. In a molded plastic snowshoe, a pair of bottom rails on the snowshoe, the rails extending downwardly for engaging terrain and extending generally in the snowshoe longitudinally but curving from front to back, whereby the rails provide forward/aft traction as well as lateral traction, and add rigidity to the molded showshoe, and wherein the rails include lateral holes at similar locations on the two rails, and including a bent wire heel lift member extending down through openings in the molded snowshoe body and engaging in the holes of the rails to provide pivot points, the heel lift being pivoted from a stored position up to a heel lift position.

11. The snowshoe of claim 10, wherein the rails comprise metal rails each with a series of downwardly extending apex points for engaging firm terrain, the metal rails being insert molded into the plastic material of the molded plastic snowshoe.

12. The snowshoe of claim 11, wherein the metal rails extend generally longitudinally in the snowshoe in spaced apart relationship, but the rails curving inwardly toward one another, then back outwardly, as they progress toward the rear.

13. The snowshoe of claim 7, wherein the molded plastic material comprises a polypropylene blend with low temperature impact modifiers.

* * * * *